US010342721B2

(12) United States Patent
Itano

(10) Patent No.: US 10,342,721 B2
(45) Date of Patent: Jul. 9, 2019

(54) FOOTREST-FOLDABLE WHEELCHAIR

(71) Applicant: SWANY CORPORATION, Kagawa (JP)

(72) Inventor: Tsukasa Itano, Higashikagawa (JP)

(73) Assignee: SWANY CORPORATION, Kagawa (JP)

( * ) Notice: Subject to any disclaimer, the term of this patent is extended or adjusted under 35 U.S.C. 154(b) by 75 days.

(21) Appl. No.: 15/469,954

(22) Filed: Mar. 27, 2017

(65) Prior Publication Data

US 2017/0281437 A1 Oct. 5, 2017

(30) Foreign Application Priority Data

Apr. 1, 2016 (JP) ..... 2016-074666

(51) Int. Cl.
*A61G 5/12* (2006.01)
*A61G 5/08* (2006.01)

(52) U.S. Cl.
CPC ..... *A61G 5/128* (2016.11); *A61G 5/085* (2016.11)

(58) Field of Classification Search
CPC ..... A61G 5/128; A61G 5/085
USPC ..... 280/250.1
See application file for complete search history.

(56) References Cited

U.S. PATENT DOCUMENTS 4,770,467 A * 9/1988 Zinn ..... A61G 5/12 297/423.37
4,988,114 A * 1/1991 Thornton, Jr. ..... A61G 5/12 280/304.1
5,593,173 A * 1/1997 Williamson ..... A61G 5/08 280/250.1
6,338,493 B1 * 1/2002 Wohlgemuth ..... A61G 5/00 135/66
7,128,332 B2 * 10/2006 Hermes ..... A61G 5/08 280/647
7,926,834 B2 * 4/2011 Willis ..... A61G 5/08 135/67
9,474,666 B1 * 10/2016 Smith ..... A61G 5/10
2007/0057561 A1 * 3/2007 Liao ..... A61G 5/12 297/423.19
2008/0265542 A1 * 10/2008 Chong ..... A61G 5/08 280/250.1

(Continued)

FOREIGN PATENT DOCUMENTS

EP 2305197 A1 * 4/2011 ..... A61G 5/12
GB 2425723 A * 11/2006 ..... A61G 5/12

(Continued)

*Primary Examiner* — Jacob D Knutson
(74) *Attorney, Agent, or Firm* — Wenderoth, Lind & Ponack, L.L.P.

(57) ABSTRACT

A wheelchair is provided which includes driving wheels, side frame, footrest arms, and footrest plates. The driving wheels are rotatably coupled to the exterior sides of the side frames. The footrest arms are movable between arm unfolded and folded positions. Each of the footrest arms is pivotably coupled to an arm pivot shaft. The arm pivot shaft is positioned on the exterior side of each of the side frames in front of each of the driving wheels. The footrest plates can support user's feet. Each of the footrest plates is coupled to the fore end of each of the footrest arms. The distance between the fore ends of the footrest arms in the arm unfolded position is smaller than the distance in the arm folded position.

15 Claims, 22 Drawing Sheets

(56) References Cited

U.S. PATENT DOCUMENTS

2011/0260421 A1* 10/2011 Willis ..... A61H 3/04
280/87.041

FOREIGN PATENT DOCUMENTS

| | | |
|---|---|---|
| JP | 2009-11691 | 1/2009 |
| JP | 2013-34788 | 2/2013 |

* cited by examiner

FOOTREST-FOLDABLE WHEELCHAIR

CROSS-REFERENCE TO RELATED APPLICATIONS

The present application claims priority under 35 U. S. C. § 119 to Japanese Patent Application No. 2016-074,666, filed Apr. 1, 2016. The contents of this application are incorporated herein by reference in their entirety.

BACKGROUND OF THE INVENTION

1. Field of the Invention

The present invention relates to a footrest-foldable wheelchair.

2. Description of the Related Art

A wheelchair includes footrests that support user's feet when the user is sitting down (see Laid-Open Patent Publication No. JP 2009-011,691 A). As shown in FIG. 22, the footrests 108 of this wheelchair protrude frontward under a flexible seat (sheet) 107 so that the user can comfortably put user's feet when sitting on the flexible seat 107. Each of the footrests 108 includes a footrest arm 141, and a footrest plate 142 that is coupled to the fore end part of the footrest arm and can pivot between plate unfolded and folded positions. The footrest plate 142 of this wheelchair will be brought in the plate folded position, when the user is going to sit on or stand up from the flexible seat 107. When the user is sitting on the flexible seat 107, the footrest plate 142 will be brought into the plate unfolded position whereby supporting user's feet. The user can move this wheelchair by rotating driving wheels 103 with user's feet being supported by the footrest plates 142. If the user who is sitting on this wheelchair is going to approach a kitchen sink, washstand, or the like, the footrest plate 142 will hit the sink, or the like, and prevent the user from approaching it. For this reason, the user is required to use the sink, washstand, or the like with straining himself or herself. In order to solve this disadvantage, the present inventor has developed a wheelchair including foldable footrests 208 each of which includes a footrest arm 241 pivotable in the vertical plane and a footrest plate 242 coupled to the footrest arm 241 as shown in FIG. 23 (Laid-Open Patent Publication No. JP 2013-034,788 A).

The footrest arms 241 of the wheelchair shown in FIG. 23 can pivot in the vertical direction away from the frontward protruding position. Accordingly, the user can conveniently use the wheelchair even when sitting on the flexible seat and approaching a kitchen sink, washstand, or the like. However, the footrest arms 241 are coupled to the exterior surface of side frames 201. For this reason, there is a problem that the distance between the right and left footrest plates 242 is larger than the conventional wheelchair shown in FIG. 22. In the case where the right and left footrest plates 242 are spaced at a large interval from each other, the space between the opposed sides of the footrest plates 242 becomes large. As a result, the user's foot may slip off the footrest plate through the space.

The present invention has been developed for solving the disadvantages. It is an object of the present invention to provide a wheelchair that can reduce the possibility that user's foot slip off a right or left footrest plate through the space between the footrest plates.

SUMMARY OF THE INVENTION

A wheelchair according to a first aspect of the present invention includes driving wheels, a pair of side frames, footrest arms, and footrest plates. The driving wheel is rotatably coupled to the exterior side of each of the side frames. The footrest arms is movable between arm unfolded and folded positions. Each of the footrest arms is pivotably coupled to an arm pivot shaft that is positioned on the exterior side of each of the side frames on the front side relative to each of the driving wheels. The footrest plates can support user's feet on their upper surfaces. Each of the footrest plates is pivotably coupled to the fore end of each of the footrest arms by a plate pivot shaft. The distance between the fore ends of the footrest arms in the arm unfolded position is smaller than the distance between the fore ends of the footrest arms in the arm folded position.

According to this wheelchair, since the distance between the fore ends of the footrest arms in the arm unfolded position is smaller so that the space between the footrest plates is narrow in the plate unfolded position, the possibility can be reduced that user's foot slips off the right or left footrest plate through the space between the footrest plates when the user of the wheelchair is putting user's feet on the footrest plates. In the arm folded position, since the distance between the fore ends of the footrest arms can larger, interference between the user and the footrest plates can be reduced when the footrest plates are folded.

In addition, in a wheelchair according to a second aspect of the present invention, in the arm unfolded position, the fore end of the footrest arm is positioned on the interior side of the wheelchair relative to the base end of the footrest arm.

According to this wheelchair, when the footrest arm is brought in the arm unfolded position, the fore end of footrest arm is positioned inward relative to the intersection between the footrest arm and the side frame so that the space between the footrest plates is narrow in the plate unfolded position. As a result, the possibility can be reduced that user's foot slips off the right or left footrest plate through the space between the footrest plates.

In addition, in a wheelchair according to a third aspect of the present invention, the arm pivot shaft is inclined in the vertical or horizontal plane, or both in vertical and horizontal planes.

According to this wheelchair, the frontward movement of the fore end of the footrest arm can move the fore end of the footrest arm inward. Accordingly, only one action of moving the fore end of the footrest arm frontward can move the fore end of the footrest arm inward.

In addition, in a wheelchair according to a fourth aspect of the present invention, the arm pivot shaft is inclined so that one of the both ends of the arm pivot shaft, which is located on the exterior side of the wheelchair, is positioned lower than another end, which is located on the interior side of the wheelchair, as viewed in front view.

According to this wheelchair, as viewed in front view, the arm pivot shaft is inclined so that the space between the fore ends of the right and left footrest arms in the arm unfolded position is narrower than the space between the fore ends of the footrest arms in the arm folded position. Accordingly, the right and left footrest plates are arranged closer to each other. As a result, the possibility can be reduced that user's foot slips off the right or left footrest plate through the space between the footrest plates.

In addition, in a wheelchair according to a fifth aspect of the present invention, the footrest arm is coupled to the arm pivot shaft and inclined relative to the arm pivot shaft an such an angle that the fore end of the footrest arm is positioned on the interior side relative to a perpendicular plane that passes through the intersection between the footrest arm and the arm pivot shaft and is perpendicular (orthogonal) to the arm pivot shaft.

According to this wheelchair, since in the arm folded position the fore end of the footrest arm is positioned on the interior side relative to the perpendicular plane of the arm pivot shaft, which passes through the intersection between the footrest arm and the arm pivot shaft, the width of the wheelchair can be small. In the arm unfolded position, since the fore end of footrest arm is positioned inward relative to the perpendicular plane of the arm pivot shaft, the space between the footrest plates, which are coupled to the fore ends of the footrest arms, can be narrower. As a result, the possibility can be further reduced that user's foot slips off right or left footrest plate through the space between the footrest plates.

In addition, in a wheelchair according to a sixth aspect of the present invention, the footrest arm stands upright in the arm folded position as viewed in front view.

According to this wheelchair, since the footrest arm stands upright in the arm folded position, the footrest arms or the footrest plates coupled to the fore ends of the footrest arms do not reduce the space above the seat or tilt outward and increase the width.

In addition, in a wheelchair according to a seventh aspect of the present invention, the arm pivot shaft is inclined relative to each of the side frames so that one of the both ends of the arm pivot shaft, which is located on the exterior side of the wheelchair, is positioned on the front side relative to another end, which is located on the interior side of the wheelchair, as viewed in plan view.

According to this wheelchair, as viewed in plan view, the arm pivot shaft is inclined so that the space between the fore ends of the right and left footrest arms in the arm unfolded position is narrower than the space between the interior ends of the footrest arms in the arm folded position. As a result, the possibility can be reduced that user's foot slips off the right or left footrest plate through the space between the footrest plates.

In addition, in a wheelchair according to an eighth aspect of the present invention, the inclination angle of the arm pivot shaft relative to the horizontal or fore-and-aft direction of the wheelchair falls within the range from 1° to 30°.

According to this wheelchair, since the arm pivot shaft is inclined at an angle within the range from 1° to 30°, opposed parts of the footrest plates can be arranged closer to each other in the arm unfolded position of the footrest arms.

In addition, in a wheelchair according to a ninth aspect of the present invention, each of the footrest arms includes a plate-pivoting shaft. The footrest plate is pivotably coupled to the footrest arm. The plate-pivoting shaft is inclined from the extension direction of the footrest arm toward the fore-and-aft direction of the wheelchair as viewed in plan view.

According to this wheelchair, since the plate-pivoting shaft is inclined from the extension direction of the footrest arm toward the fore-and-aft direction of the wheelchair, the frontward inclination of the interior ends of the right and left footrest plates can be small as viewed from the seat in the unfolded position.

In addition, in a wheelchair according to a tenth aspect of the present invention, the footrest plate has a roughly rectangular shape as viewed in plan view. The inclination angle of the plate-pivoting shaft relative to the extension direction of the footrest arm is designed so that the plate-pivoting shaft extends parallel to the fore-and-aft direction of the wheelchair.

According to this wheelchair, opposed parts of the footrest plates can be arranged parallel to each other. Accordingly, the gap between the opposed parts can be constant. Also, the right and left footrest plates can be aligned in the plate unfolded position so that the footrest plates are not inclined toward the fore-and-aft direction as viewed from the seat. As a result, user's feet can be stably supported by the footrests.

In addition, in a wheelchair according to an eleventh aspect of the present invention, the footrest arm includes first and second arms, and rotation portion. The first arm portion has a base end which is coupled to the side frame, and a middle portion that is bent downward. The second arm portion has a rear end which is coupled to the fore end of the first arm portion, and a fore end which is coupled to the footrest plate. The rotation portion rotatably couples the second arm portion to the first arm portion about the first arm portion as the rotation axis.

According to this wheelchair, in the arm unfolded position of the footrest arm, the second arm portions can rotate about the first arm portions as the rotation axes so that the right and left footrest plates can be aligned by adjusting the angles of the footrest plates. In the arm folded position of the footrest arm, the second arm portions can rotate in the opposite direction to the rotation direction in the case of the arm unfolded position about the rotation axes so that the footrest plates are brought substantially parallel to a plane perpendicular the pivot direction of the footrest arm. Accordingly, the space occupied by the footrest plates in the width direction as viewed in plan view can be small. As a result, the folded footrest plates can be compact.

In addition, in a wheelchair according to a twelfth aspect of the present invention, the footrest arm includes first and second arms, and rotation portion. The first arm portion has a base end which is coupled to the side frame. The second arm portion has a rear end which is coupled to the fore end of the first arm portion, a middle portion which is bent downward, and a fore end which is coupled to the footrest plate. The rotation portion rotatably couples the second arm portion to the first arm portion about the first arm portion as the rotation axis.

According to this wheelchair, the fore ends of the second arm portions can move inward in the rotation so that the fore ends of the right and left footrest plates approach each other in the plate unfolded position of the footrest plates. As a result, the possibility can be effectively reduced that user's foot slips off the right or left footrest plate through the space between the footrest plates. Also, after the second arm portions rotate about their axes so that the entire footrest arms extend in the vertical direction, the footrest arms can pivot rearward. As a result, the footrest arms and the footrest plates do not occupy large space when the footrest is folded.

In addition, in a wheelchair according to a thirteenth aspect of the present invention, opposed parts of the right and left footrest plates at least partially contact each other in the plate unfolded position of the footrest plate.

According to this wheelchair, since opposed parts of the right and left footrest plates at least partially contact each other, the possibility can be reduced that user's foot slips off right or left footrest plate through the space between the footrest plates when the user sitting on the wheelchair.

In addition, in a wheelchair according to a fourteenth aspect of the present invention, first and second engagement portions that can engage with each other are provided on opposed parts of the footrest plates.

According to this wheelchair, even if a lateral force is applied to the footrest arm or the footrest plate or the wheelchair is subjected to vibration, the connection between the right and left footrest plates can be maintained by the engagement between the right and left footrest plates. As a result, the possibility can be reduced that an unexpected increase of the space between the footrest plates causes user's foot slip off right or left footrest plate through the space between the footrest plates.

Furthermore, a wheelchair according to a fifteenth aspect of the present invention includes driving wheels, a pair of side frame, footrest arms, footrest plates, and a central plate. The driving wheels are rotatably coupled to the exterior sides of the side frames. The footrest arms are movable between arm unfolded and folded positions. Each of the footrest arms is pivotably coupled to an arm pivot shaft. The arm pivot shaft is positioned on the exterior side of each of the side frames on the front side relative to each of the driving wheels. The footrest plates can support user's feet. Each of the footrest plates is pivotably coupled to the fore end of each of the footrest arms by a plate pivot shaft. The central plate has sides which are coupled to opposed sides of the right and left footrest plates, and a main surface that serves, together with the right and left footrest plates, to be able to support user's feet.

According to this wheelchair, since the central plate can couple the right and left footrest plates to each other, the right and left footrest plates can serve together with the central plate as a one-piece footrest plate. Also, since the gap between the right and left footrest plates can be closed by the central plate, the possibility can be reduced that user's foot slips off right or left footrest plate through the space between the footrest plates.

In addition, in a wheelchair according to a sixteenth aspect of the present invention, one of the sides of the central plate is hinged to the interior side of one of the right and left footrest plates, and another side of the central plate is provided with an engagement portion that can engage with the opposed side of another footrest plate, which is located opposite to the hinged side.

According to this wheelchair, the right and left footrest plates can be coupled to each other by pivoting the central plate, which is hinged to the one of the footrest plates. Furthermore, another side of the central plate, which is opposite to the hinged side, can be coupled to an engagement portion of another footrest plate which is arranged on its interior side.

In addition, in a wheelchair according to a seventeenth aspect of the present invention, a recessed part is formed on the upper surface of the one of the footrest plates to which the central plate hinged. The central plate can fit in the recessed part so that the central plate can be accommodated in the one of the footrest plates.

According to this wheelchair, when the central plate is not used or when the footrest arms are pivoted rearward, the central plate can be accommodated in the one of the footrest plates so that the central plate can avoid contact with something in front of the user or does not come in contact with something beside the way of the footrest arm in the pivot movement.

In addition, in a wheelchair according to an eighteenth aspect of the present invention, protrusions are provided in the recessed part of the one of the footrest plates, and hollows are provided on the main surface of the central plate. The protrusions can fit in the hollows.

According to this wheelchair, the protrusions on the one of the footrest plates can prevent user's foot from getting into the recessed part, in other words, prevent that user's one foot is located lower than another foot. Additionally, since the central plate has hollows in which the protrusions can fit, the central plate can be accommodated without interference with the protrusions when the central plate is accommodated into the footrest plate.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF EMBODIMENTS

Figure 1:
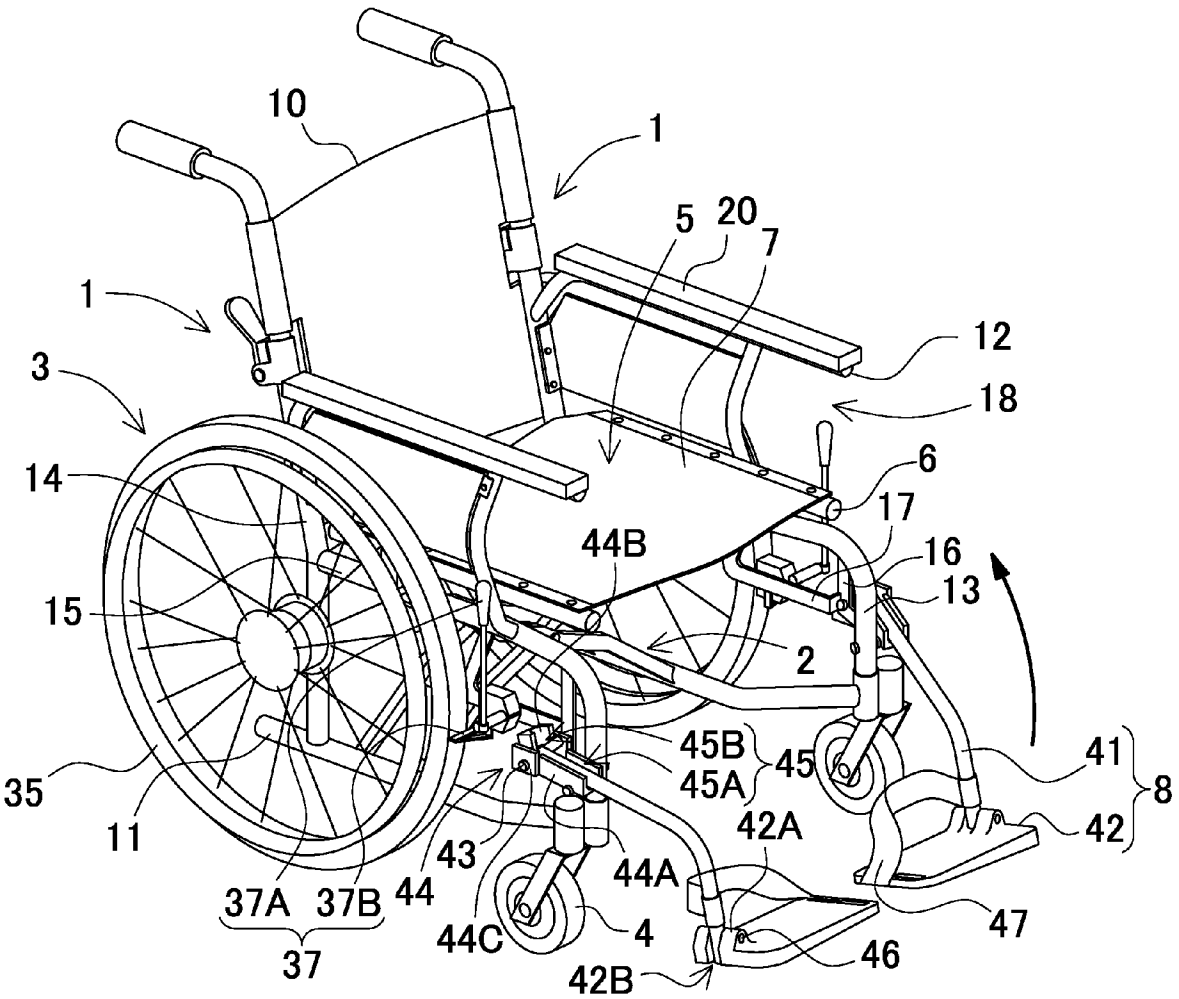
FIG. 1 is a perspective view of a wheelchair according to an embodiment of the present invention.

The embodiments will now be described with reference to the accompanying drawings, wherein like reference numerals designate corresponding or identical elements throughout the various drawings.

It should be appreciated, however, that the embodiments described below are illustrations of a wheelchair to give a concrete form to technical ideas of the invention, and a wheelchair of the invention is not specifically limited to description below. Furthermore, it should be appreciated that the members shown in claims attached hereto are not specifically limited to members in the embodiments. Unless otherwise specified, any dimensions, materials, shapes and relative arrangements of the parts described in the embodiments are given as an example and not as a limitation. Additionally, the sizes and the positional relationships of the members in each of drawings are occasionally shown exaggeratingly for ease of explanation. Members same as or similar to those of this invention are attached with the same designation and the same reference numerals and their description is omitted. In addition, a plurality of structural elements of the present invention may be configured as a single part that serves the purpose of a plurality of elements, on the other hand, a single structural element may be configured as a plurality of parts that serve the purpose of a single element.

Also, it should be noted that although the terms "horizontal(ly)", "vertical(ly)", "perpendicular(ly)", and "parallel" are used in the specification and claims, these terms are not always intended to strictly mean "horizontal", "vertical", "perpendicular", and "parallel" directions. These terms are intended to include directions slightly inclined from these directions.

First Embodiment

FIG. 1 is a perspective view showing a wheelchair according to a first embodiment. The wheelchair shown in FIG. 1 includes driving wheels 3, a pair of side frames 1, foldable links 2, seat frames 6, a flexible seat 7, casters 4, and footrests 8. The driving wheels 3 are coupled to the exterior sides of the side frames 1. The foldable links 2 couples the pair of side frames 1 to each other. The seat frames 6 are coupled to the top ends of the foldable links 2. The flexible seat 7 is coupled to the seat frames 6 of the foldable links 2. The casters 4 are coupled to the front parts of the side frames 1, and are free to swivel in the horizontal direction. The footrests 8 are coupled to the side frames 1. Each of the footrests 8 includes a footrest plate 42 that supports user's foot on its upper surface in an unfolded position, and a footrest arm 41 that is coupled to the side frame 1. The footrest plate 42 is coupled to the footrest arm 41. The side frames 1 of the wheelchair are foldably coupled to each other by the foldable links 2. The width of the wheelchair can be reduced by folding the foldable links 2 by approaching the both side frames 1 to each other.

(Side Frames 1)

Figure 2:
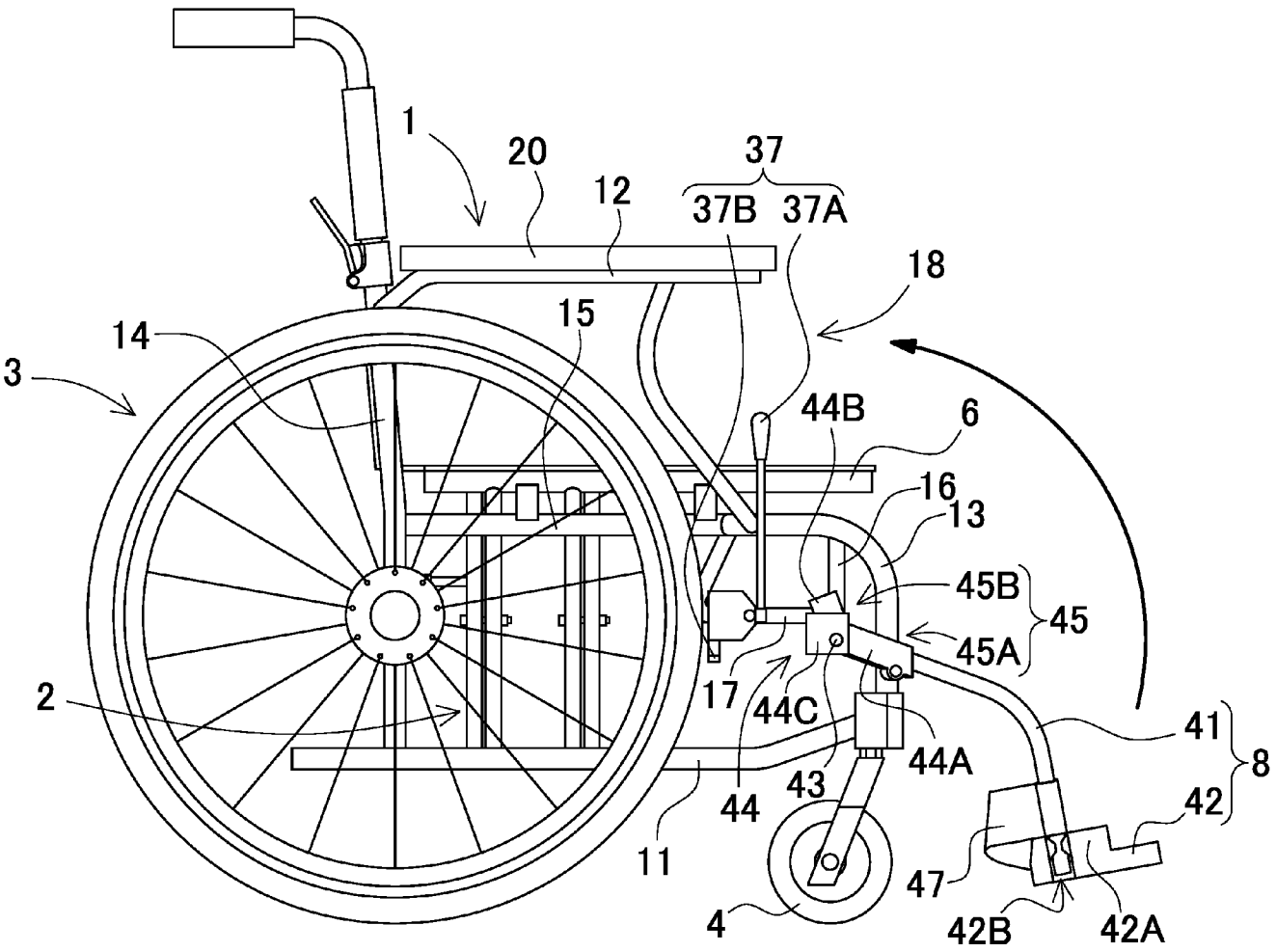
FIG. 2 is a side view of the wheelchair shown in FIG. 1.

FIG. 2 is a side view of the wheelchair of FIG. 1. Each of the side frames 1 of the wheelchair shown in FIG. 2 includes an elbow rest frame portion 12, a vertical frame portion 14, and a bottom frame portion 11. The elbow rest frame portion 12 extends in the horizontal direction. An elbow rest 20 is arranged on the upper surface of the elbow rest frame portion 12. The vertical frame portion 14 is coupled to the rear end part of the elbow rest frame portion 12. The bottom frame portion 11 extends in the horizontal position, and is coupled to the lower end part of the vertical frame portion 14. The side frame 1 has accommodation space 18 which is provided under the elbow rest frame portion 12 and can accommodate the footrest plate 42 in a plate folded position.

In addition, the side frames 1 of the wheelchair of FIG. 2 include a middle frame portion 15 which extends in the horizontal direction between the elbow rest frame portion 12 and the bottom product frame portion 11. The rear end of the middle frame portion 15 is coupled to the central part of the vertical frame portion 14. The front end of the middle frame portion 15 is coupled to the bottom frame portion 11 through a front frame portion 13 which is located in the lower part of the middle frame portion 15. The illustrated middle frame portion 15 includes a bent front part as the front frame portion 13 which is bent downward.

(Footrest Attachment Frame Portion 16)

Each of the side frames 1 of the wheelchair of FIG. 1 includes a footrest attachment frame portion 16 which is arranged in the corner part defined by the front part of the middle frame portion 15 and the front frame portion 13. The illustrated footrest attachment frame portion 16 is an L-shaped member which is bent at its central part. One end of the illustrated footrest attachment frame portion is coupled to the front part of the middle frame portion 15, and another end is coupled to the central part of the front frame portion 13. The footrest arm 41 is coupled to the exterior surface of the footrest attachment frame portion 16. As shown in the front view of FIG. 4, the illustrated footrest attachment frame portion 16 is arranged on the exterior side relative to the middle and front frame portions 15 and 13. Brake frames 17 are coupled to the bent parts of the footrest attachment frame portions 16, and extend rearward. Brakes 37 are mounted to the brake frames 17, and can contact the driving wheels 3 for braking.

(Footrest 8)

Figure 3:
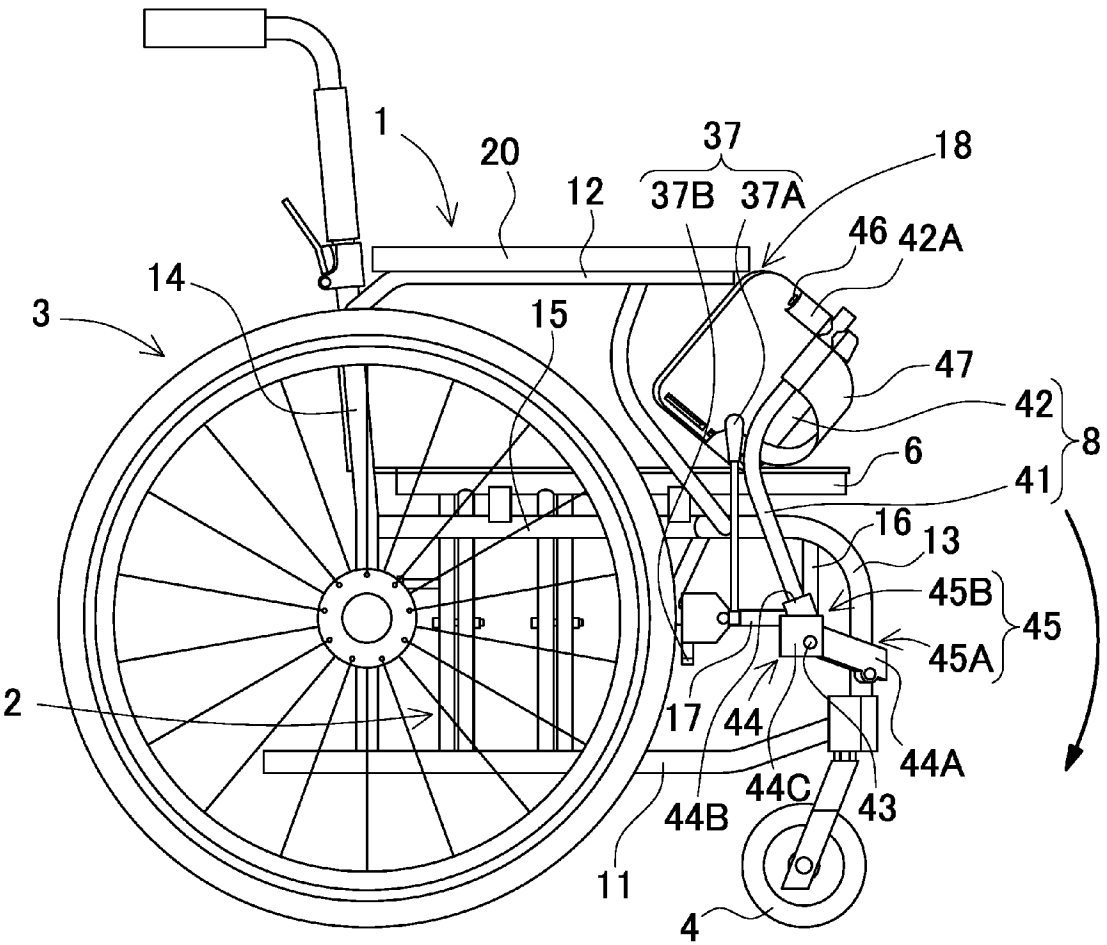
FIG. 3 is a side view showing the wheelchair of FIG. 2 with its footrest arms brought in an arm folded position.

The wheelchair of FIG. 1 includes the pair of footrests 8 in front of a seat 5. The footrests 8 can support user's feet when the user is sitting on the seat. Each of the footrests 8 includes the footrest arm 41, which is coupled to the exterior surface of the side frame 1, and the footrest plate 42, which is arranged at the fore end of the footrest arm 41. The base end of the footrest arm 41 is coupled to the footrest attachment frame portion 16 through an arm pivot shaft 43 so that the fore end of the footrest arm 41 can pivot in a vertical plane in the fore-and-aft direction. Accordingly, the illustrated footrest 8 can stand upright when folded. The side view of FIG. 2 shows that the footrests 8 are located in the forward position. When the footrests 8 are used, as shown in FIG. 2, the footrest arms 41 pivot frontward so that the fore ends of the footrest arms 41 are positioned in front of the side frames 1 (arm unfolded position). The side view of FIG. 3 shows that the footrests 8 are folded. In the case where the wheelchair is required to collapse in the right-and-left direction or the footrests 8 are required to retract, the footrest arm 41 can be held on the rear side relative to the front frame portion 13 as shown in FIG. 3 (arm folded position). When the footrest arm 41 is brought into the arm folded position, the footrest plate 42 is accommodated in the accommodation space 18. According to this foldable construction of the footrests 8, the wheelchair can be more compact in storage where the wheelchair is collapsed by approaching the side frames 1 to each other.

Figure 4:
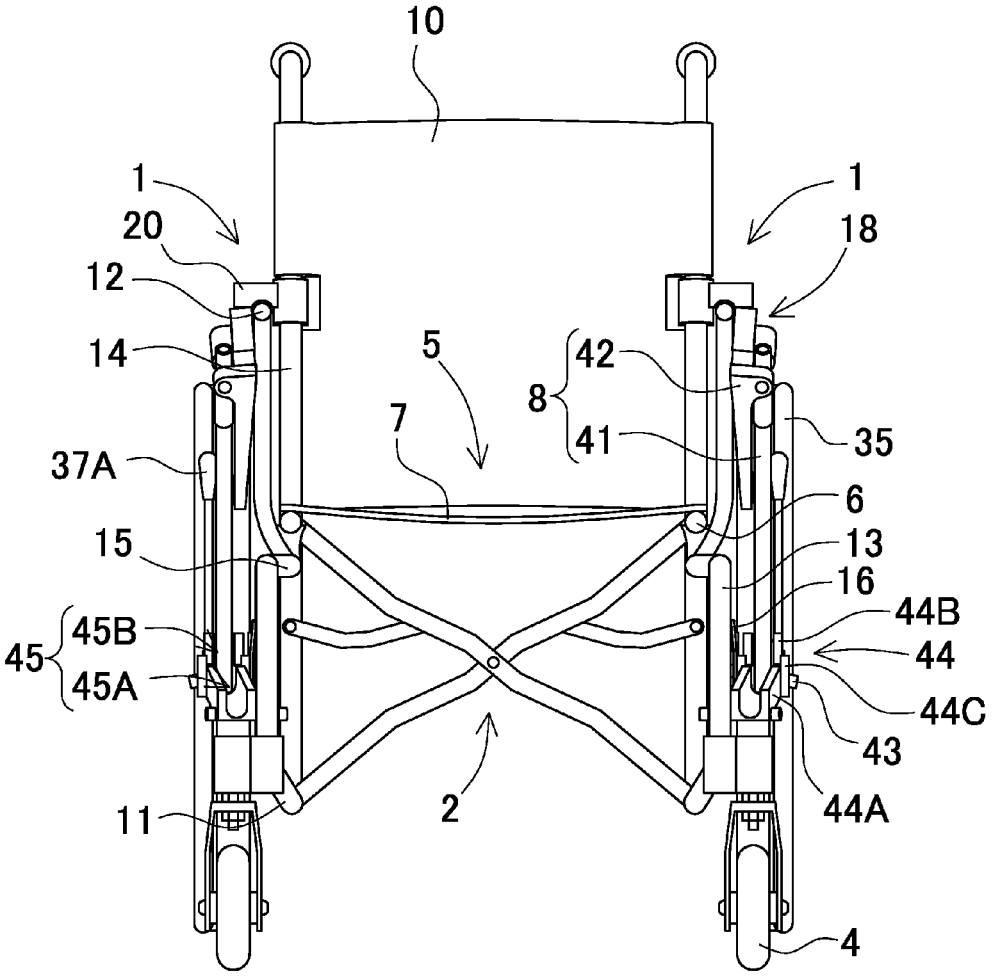
FIG. 4 is a front view of the wheelchair according to the embodiment of the present invention.
Figure 5:
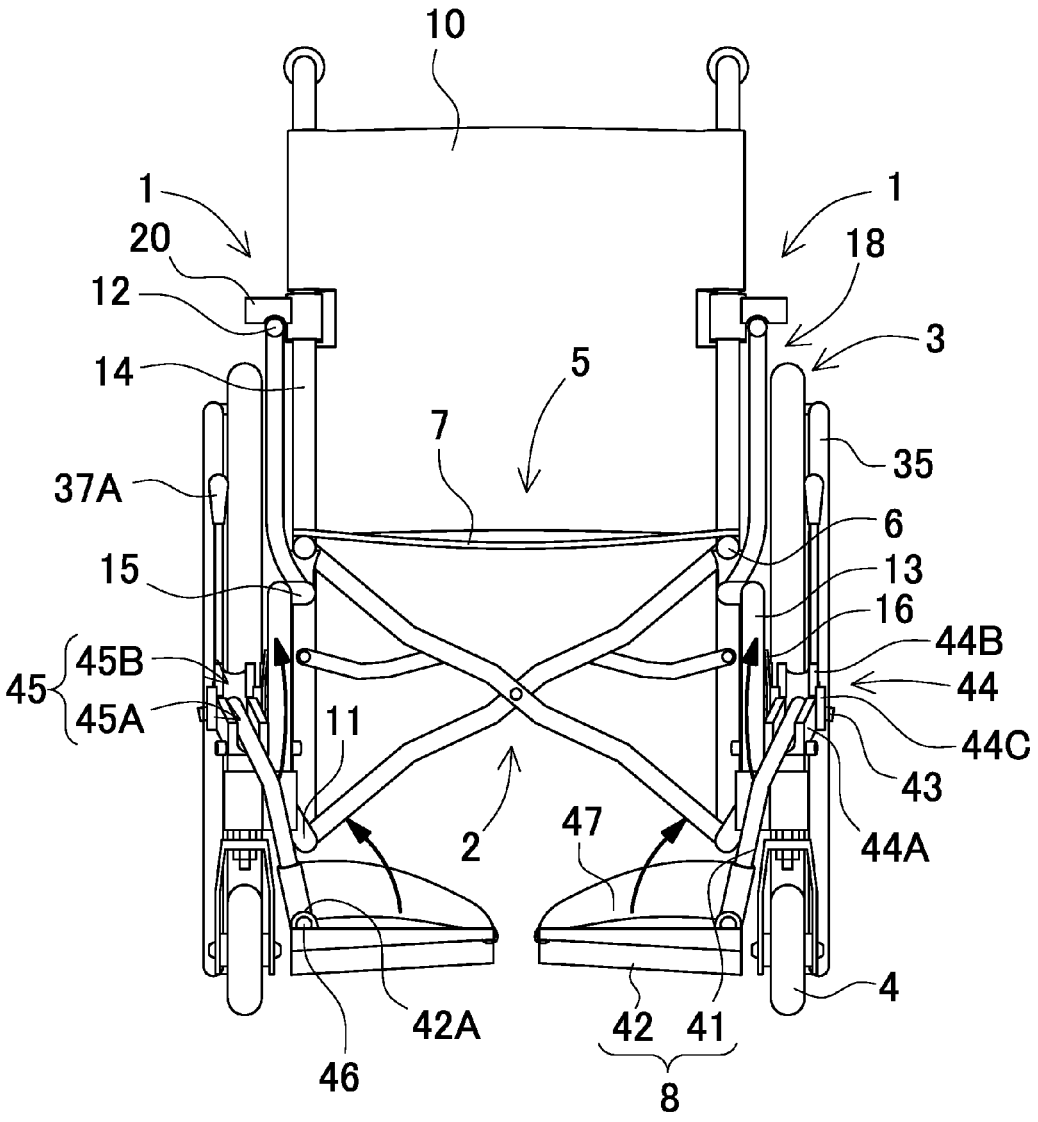
FIG. 5 is a front view showing the wheelchair of FIG. 4 with its footrest arms brought in an arm unfolded position.
Figure 6:
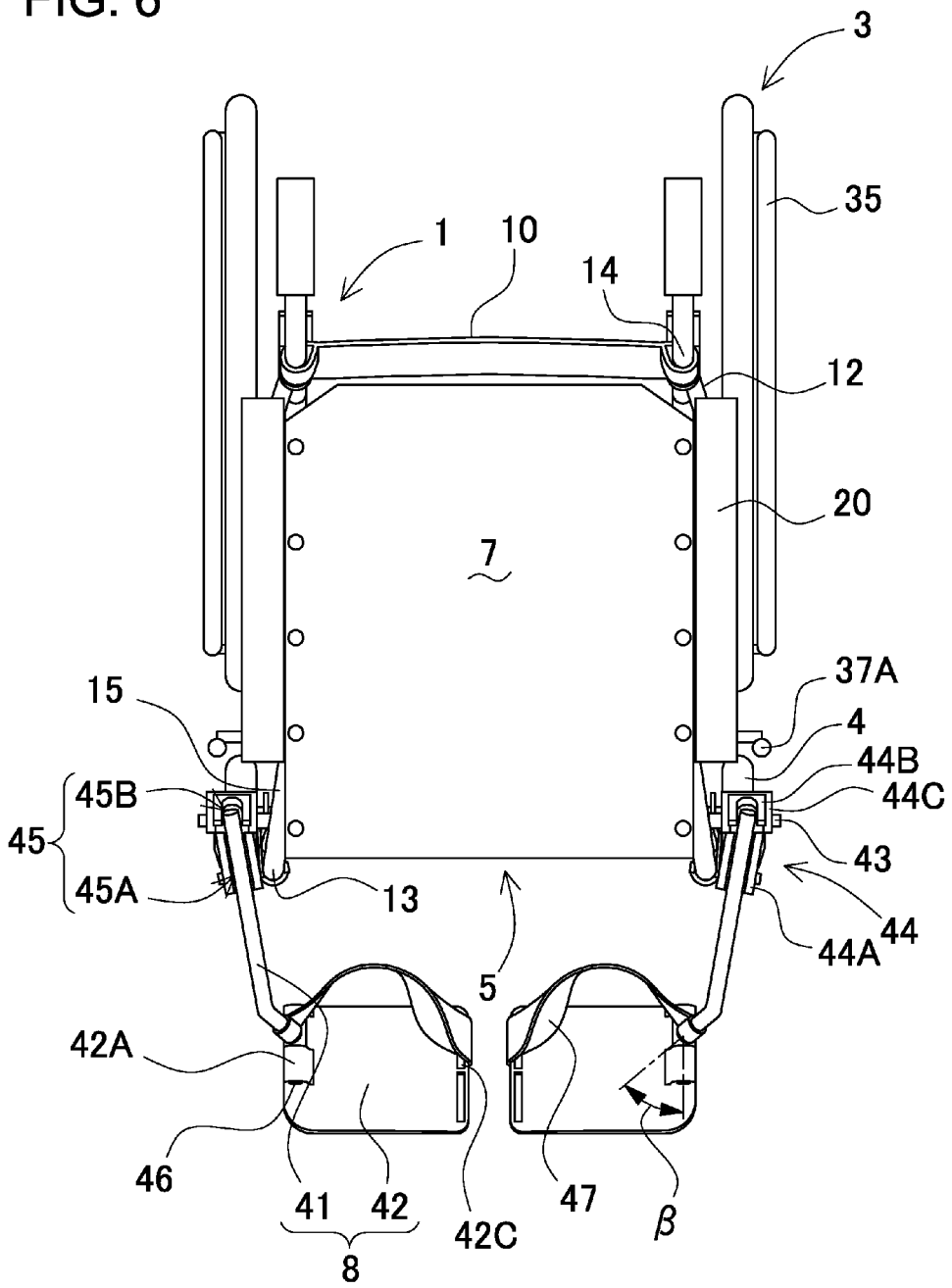
FIG. 6 is a plan view of the wheelchair shown in FIG. 1.
Figure 7:
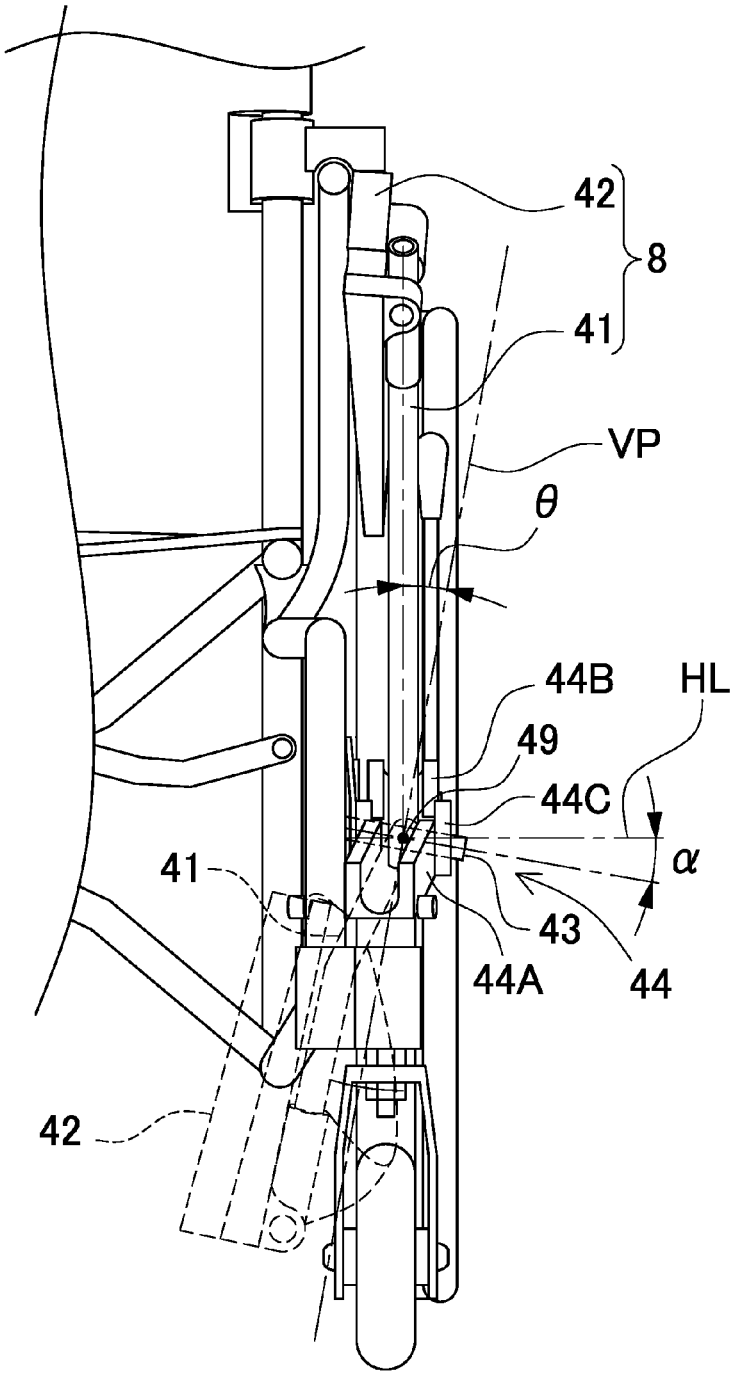
FIG. 7 is an enlarged front view showing the essential part of the wheelchair shown in FIG. 1.

FIGS. 4 and 5 are front views of the wheelchair shown in FIG. 1. FIG. 6 is a plan view of the wheelchair shown in FIG. 1. FIG. 7 is an enlarged front view showing the essential part of the wheelchair shown in FIG. 1. As shown in FIG. 4, in this wheelchair, the footrest arm 41 is pivotably coupled to the exterior surface of the footrest attachment frame portion 16 in the fore-and-aft direction. The footrest plate 42, which can support the user's foot on its upper surface in the plate unfolded position, is coupled to the fore end of the footrest arm 41. FIG. 5 shows the wheelchair in the arm unfolded position of the footrest arms 41, and the plate unfolded position where the upper surfaces of the footrest plates 42 are brought in the horizontal position so that the footrest plates 42 can support the user's feet. Before the footrest arm 41 pivots to the arm folded position, as shown in FIG. 4, the footrest plate 42 pivots about a plate pivot shaft 46 as the rotation axis into a vertical position so that the footrest plate 42 does not come in contact with something beside the way of the footrest arm in the folding movement. In addition, the illustrated footrest 8 includes a supporting strip 47 which extends from the fore end of the footrest arm 41 to the interior side of the footrest plate 42, and holds the user's foot on the footrest plate 42 to prevent a slip off.

(Arm Pivot Shaft 43)

The arm pivot shaft 43 is a shaft for pivotably coupling the footrest arm 41 to the footrest attachment frame portion 16 in the fore-and-aft direction. FIG. 7 is an enlarged view showing the essential part around the arm pivot shaft 43. The arm pivot shaft 43 is inclined with respect to the horizontal line HL as viewed in front view. The illustrated arm pivot shaft 43 is inclined in a vertical plane so that one of the both ends of the arm pivot shaft 43, which is located on the exterior side of the wheelchair, is positioned lower than another end, which is located on the interior side of the wheelchair. The arm pivot shaft 43 forms an inclination angle $\alpha$ to the horizontal line HL of the side frame 1. The inclination angle $\alpha$ falls within the range from 1° to 30°. The inclination angle $\alpha$ preferably falls within the range from 3° to 20°. The inclination angle $\alpha$ more preferably falls within the range from 5° to 15°. Since the arm pivot shaft 43 is inclined, the fore end of the footrest arm 41 extends toward the interior side of the wheelchair when the footrest arm 41 is brought into the arm unfolded position as shown by the dashed lines of FIG. 7. Since the fore ends of the footrest arms 41 extend inward, the gap between the footrest plates 42 can be small which are coupled to the fore ends of the right and left footrest arms 41. In particular, in the case where the inclination angle $\alpha$ falls within the range from 5° to 15°, the right and left footrest plates 42 can be sufficiently close to each other but the distance between the fore ends of the right and left footrest arms 41 can be not too small so that sufficient space can be provided for the footrest plates 42.

(Footrest Arm 41)

The footrest arm 41 of the wheelchair shown in FIG. 1 is a rod-shaped member. As shown in FIG. 2, when the footrest arm 41 pivots to the arm unfolded position, the central part is curved so that the fore end extend downward. However, the footrest arm 41 is not necessarily curved. Alternatively, the footrest arm may be formed straight or bent in an L shape. The base end part of the footrest arm 41 is coupled to the exterior surface of the footrest attachment frame portion 16 by the arm pivot shaft 43 so that the footrest arm 41 can lie in the vertical plane containing the fore-and-aft direction when folded. The footrest plate 42, which can support the user's foot, is pivotably coupled to the fore end of the footrest arm 41. The fore ends of the footrest arms 41 are closer to each other in the arm unfolded position shown in FIG. 5 than the arm folded position shown in FIG. 4.

The rear end part of the footrest arm 41 intersects with and is coupled to the arm pivot shaft 43 as shown in the enlarged view of FIG. 7. More specifically, the footrest arm 41 is coupled to the arm pivot shaft 43 at an inclination angle relative to the arm pivot shaft 43. In the illustrated wheelchair, the footrest arm 41 is inclined relative to the arm pivot shaft 43 at such an angle that the fore end of the footrest arm 41 is positioned on the interior side of the wheelchair relative to a perpendicular plane VP. The perpendicular plane VP passes through the intersection 49 between the footrest arm 41 and the arm pivot shaft 43, and is perpendicular to the arm pivot shaft 43. This angle of the footrest arm 41 relative to the arm pivot shaft 43 is defined as an inclination angle $\theta$. The inclination angle $\theta$ is fixed irrespective of the fore-and-aft pivot movement of the footrest arm 41. The inclination angle $\theta$ falls within the range not greater than 30°. Preferably, the inclination angle $\theta$ is designed equal to the inclination angle $\alpha$. The reason is that the footrest arm can stand upright in the arm folded position.

The arm pivot shaft 43 is inclined in a vertical direction at the inclination angle $\alpha$ relative to the horizontal line HL so that one of the both ends of the arm pivot shaft 43, which is located on the exterior side of the wheelchair, is positioned lower than another end, which is located on the interior side of the wheelchair, as viewed in front view. Correspondingly, the perpendicular plane VP, which is perpendicular to the arm pivot shaft 43, is inclined at the inclination angle $\alpha$ with respect to the vertical direction. Accordingly, the upper side of the perpendicular plane VP is located on the exterior side of the wheelchair, while the lower side is located on the interior side of the wheelchair. Contrary to this, in the case where the footrest arm is coupled perpendicularly to the arm pivot shaft 43 as in the wheelchair described in the background art, the footrest arm pivots in the perpendicular plane VP. In this case, the fore end of the footrest arm moves toward the interior side of the wheelchair as the footrest arm pivots frontward. On the other hand, the fore end of the footrest arm moves to the exterior side of the wheelchair as the footrest arm pivots upward. In other words, the fore ends move outward as approaching the arm folded position, and the width of the wheelchair becomes greater. As a result, the wheelchair may interfere with something when moving on a narrow way or occupy large space in storage.

To address this, in the wheelchair according to the first embodiment, the footrest arm 41 intersects with the arm pivot shaft 43 at such an angle that the footrest arm 41 is inclined at the inclination angle $\theta$ relative to the perpendicular plane VP as shown in the enlarged view of FIG. 7. According to this construction, the footrest arm 41 is positioned on the interior side of the wheelchair in the arm folded position as compared with the case where the footrest arm is perpendicularly coupled to the arm pivot shaft. Therefore, the width of the wheelchair is not increased by the footrest arms. In the wheelchair according to the first embodiment, also in the arm unfolded position, the footrest arms are inclined at the inclination angle $\theta$ relative to the perpendicular planes VP of the arm pivot shafts 43 each of which passes through the intersection between the footrest arm 41 and the arm pivot shaft 43 so that the fore ends of the footrest arms 41 can be positioned on the interior side relative to the perpendicular plane VP of the arm pivot shaft 43. That is, the fore ends of the footrest arms 41 are positioned on the interior side of the wheelchair as compared with the case where the footrest arms are perpendicularly coupled to the arm pivot shafts. For this reason, the footrest plates 42, which are located at the fore ends of the right and left footrest arms 41, can be closer to each other. As a result, the space between the footrest plates 42 can be narrow. Therefore, the possibility can be reduced that user's foot slip off right or left footrest plate 42 through the space.

As discussed above, according to the construction where the arm pivot shaft 43 is inclined in the vertical direction relative to the horizontal line HL, and the footrest arm 41 is inclined toward the interior side of the wheelchair from the perpendicular plane VP of the arm pivot shaft 43, it is possible to prevent width increase of the wheelchair by the footrest arms 41 which lie off the wheelchair in the folded position of the footrest arm 41 as shown in FIG. 4, while the fore ends of the footrest arms 41 can be positioned further inside in the arm unfolded position of the footrest arms 41 as shown in FIG. 5.

In addition, as shown in FIG. 7, the distance between the fore ends of the right and left footrest arms 41 of the wheelchair in the arm folded position of the footrest arms 41 is greater than the arm unfolded position. Accordingly, when the footrest plates 42 are brought into the folded position, and the footrest arms 41 pivot to the arm folded position, interference between the user and the footrest plates 42 or the footrest arms 41 can be reduced when the user is sitting on the seat. In the illustrated wheelchair, each of the both side end parts of the footrest arms in the arm folded position stands upright and extends along one vertical line as viewed in front view. In the illustrated wheelchair, the upright posture of the footrest arm 41 can be achieved by designing the inclination angle θ of the footrest arm 41 equal to the inclination angle α. According to this construction, since the footrest arms 41 can stand upright, the footrest arms 41 or the footrest plates 42 do not tilt inward and reduce the space above the seat or tilt toward the exterior side of the wheelchair and increase the width when the footrest arms 41 pivot to the arm folded position. It is preferable that when pivoting to the arm folded position the footrest arms 41 are arranged on the interior side relative to the grip rings 35, which are arranged on the exterior sides of the driving wheels 3. The reason is that the width of the wheelchair can be small to allow the user to easily move the wheelchair on even a narrow way, and that the wheelchair can be compact when folded. Additionally, since the footrest arms 41 stand upright in the arm folded position, the right and left footrest arms 41 and the footrest plates will not interfere with each other when the side frames 1 are moved to approach each other by the foldable links 2 to collapse the wheelchair. Consequently, the wheelchair can be more compact when collapsed. However, the inclination angle θ is not necessarily required to be equal to the inclination angle α. In the case where the inclination of the footrest arms 41 is designed to position the fore ends of the footrest arms 41 on the interior side relative to the perpendicular planes VP, the distance between the fore ends of the right and left footrest arms 41 can be closer in the pivot movement to the arm unfolded position.

FIG. 5 is a front view showing the wheelchair shown in FIG. 4 with its footrest arms 41 brought in the arm unfolded position by the pivot movement. As discussed above, according to the construction where the arm pivot shaft 43 is inclined relative to the side frame 1, and the footrest arm 41 is also inclined relative to the arm pivot shaft 43, the fore end of the footrest arm 41 moves toward the interior side of the wheelchair as shown in FIG. 5 in the pivot movement to the arm unfolded position. The fore ends of the illustrated footrest arms 41 are positioned on the interior side relative to the base ends of the footrest arms 41, which are coupled to the footrest attachment frame portions 16. Accordingly, the space between the footrest plates 42, which are coupled to the fore ends of the right and left footrest arms 41, can be narrow. Therefore, the possibility can be reduced that user's foot slip off right or left footrest plate 42 through the space when using this wheelchair.

In addition, according to the aforementioned construction, in the switching movement of the footrest arms 41 of the wheelchair from the arm folded position shown in FIG. 4 to the arm unfolded position shown in FIG. 5, only the frontward pivot movement of the footrest arms 41 can move the fore ends of the footrest arms 41 from the upright posture toward the interior side of the wheelchair in synchronization with the frontward pivot movement. Also, in the switching movement from the arm unfolded position to the arm folded position, only the rearward pivot movement of the footrest arms 41 can move the fore ends of the footrest arms 41 from the interior side toward the upright posture. Therefore, the user of the wheelchair can use and fold the footrests 8 by a single and simple action.

(Footrest Plate 42)

Figure 23:
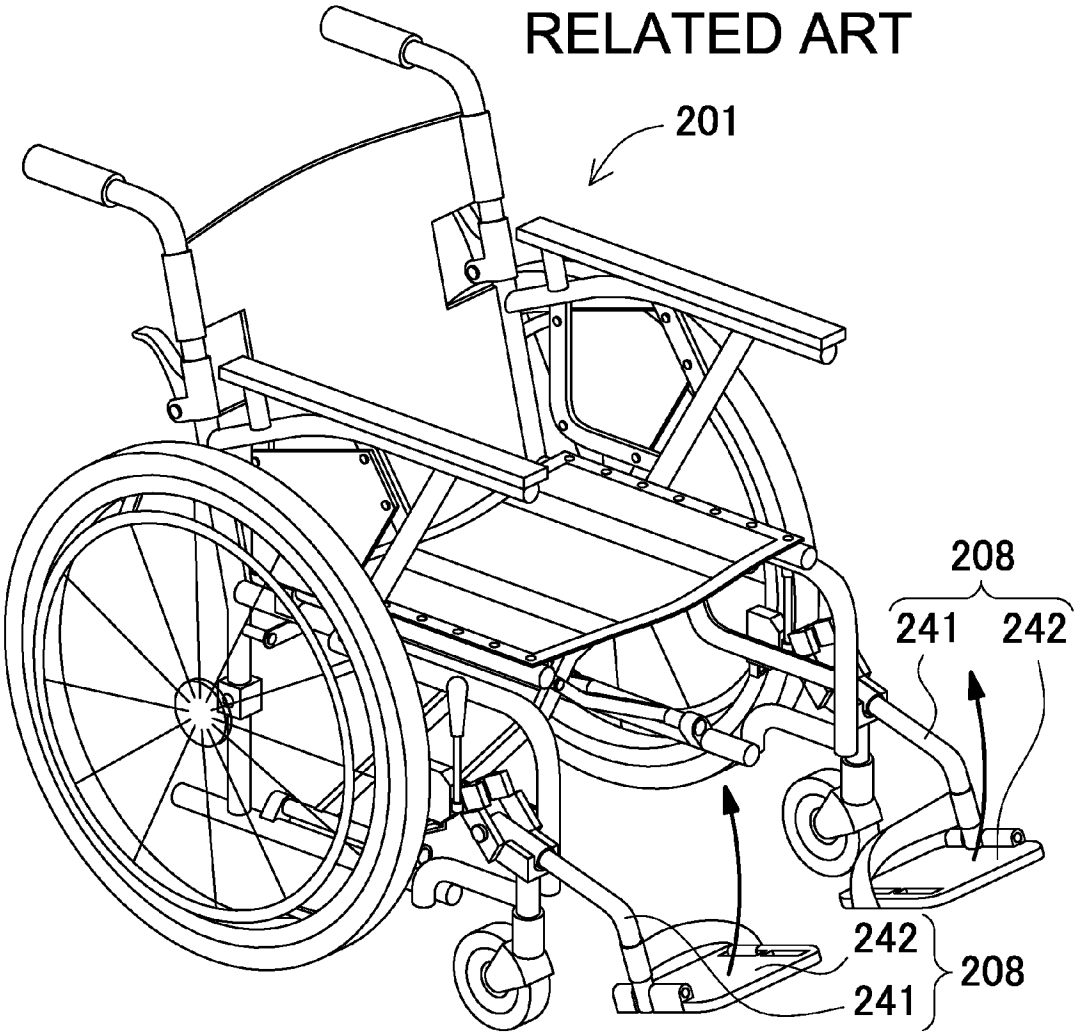
FIG. 23 is a perspective view showing a wheelchair that has been developed by the present inventor in advance of the present invention.

As shown in FIGS. 4 and 5, the footrest plates 42 are coupled to the fore ends of the footrest arms 41 through the plate pivot shafts 46, and can be switched between the plate folded position and the plate unfolded position. The footrest plate 42 can support user's feet on its upper surface when the footrest plates 42 are brought into the plate unfolded position in the arm unfolded position of the footrest arms 41 as shown in FIG. 5. Also, the footrest plates 42 can stand upright by folding them into the plate folded position so as not to obstruct the folding movement of the footrest arms 41 when the footrest arms 41 are brought into the arm folded position as shown in FIG. 4. The outline of the footrest plate 42 shown in FIG. 1 is a plate shape. The footrest plate 42 includes a plate-side bearing portion 42A is coupled to the base end of footrest plate 42. The plate-side bearing portion 42A supports the plate pivot shaft 46, which is coupled to the footrest arm 41. Also, a stopper groove 42B is formed as a recessed part on the base end of the footrest plate 42 shown in FIG. 1. The stopper groove 42B guides the fore end of the footrest arm 41, and holds the footrest plate 42 at a predetermine angle so that the footrest plate 42 is held in the plate unfolded position. In order to unfold the footrest plate 42, the user pivots the footrest plate 42 about the plate pivot shaft 46 so that the fore end of the footrest arm 41 contacts the recessed surface of the stopper groove 42B. As a result, the footrest plate 42 is held in the plate unfolded position. When the footrest plates 42 are folded into the plate folded position, as shown in FIG. 4, the footrest plates 42 are held in the predetermined plate folded position where the upper surface of the footrest plate 42 faces the footrest arm 41. Since the footrest arms 41 are inclined with their fore ends being positioned inward, the right and left footrest plates 42 are arranged closer to each other in the plate unfolded position of the footrest plate 42 as compared with the wheelchair described in the background art shown in FIG. 23. That is, since the gap between the right and left footrest plates 42 is smaller, the possibility can be prevented that user's foot slips off right or left footrest plate 42 through the space. A slit 42C is formed on the interior end of the footrest plate 42. The supporting strip 47 is held in the slit 42C on the interior end.

As shown in FIG. 5, since the arm pivot shafts 43, which couple the footrest arms 41 to the side frames 1 of the wheelchair, are inclined, the gap between the right and left footrest plates 42 can be small. For example, the gap between the footrest plates 42 can be dimensioned not greater than 5 cm. It is preferable that the gap is not greater than 3 cm. It is more preferable that the gap is not greater than 1 cm. Since the gap between the right and left footrest plates 42 is small, the possibility can be effectively reduced that user's foot slips off right or left footrest plate through the gap when the user sitting on the seat of the wheelchair.

(Plate Pivot Shaft 46)

The plate pivot shaft 46 is a shaft for pivotably coupling the footrest plate 42 to the fore end of the footrest arm 41. FIG. 6 is the plan view of the wheelchair shown in FIG. 1. As shown in FIG. 6, the plate pivot shaft 46 is inclined relative to the extension direction of the footrest arm 41. The axis of the illustrated plate pivot shaft 46 extends in the fore-and-aft direction of the wheelchair. The angle of the plate pivot shaft 46 relative to the extension direction of the footrest arm 41 is defined as the inclination angle β. Since the plate pivot shaft 46 is inclined, even in the case where the footrest plates 42 of the illustrated wheelchair have a roughly rectangular shape in plan view, the gap between the right and left footrest plates 42 can be small and constant along the entire their opposed edges. As a result, the possibility can be reduced that user's foot slips off right or left footrest plate through the gap. Also, since the plate pivot shaft 46 is inclined, the frontward inclination of the interior end of the footrest plate 42 can be small as viewed from the seat. The inclination angle β falls within the range not greater than 30°, for example. The inclination angle β is preferably set to such an angle that the plate pivot shaft 46 extends parallel to the fore-and-aft direction of the wheelchair. It is more preferably that the right and left plate pivot shafts 46 extend parallel to the fore-and-aft direction of the wheelchair. The reason is that even in the case where the footrest plates have a roughly rectangular shape in plan view the opposed edges of the right and left footrest plates 42 can be parallel to each other so that the gap between the footrest plates 42 can be fixed as shown in the plan view of FIG. 6. Also, the right and left footrest plates 42 can be aligned so that the footrest plates 42 are not inclined frontward or rearward. As a result, user's feet can be stably supported by the footrests. Such an inclination angle β that the right and left plate pivot shafts 46 are parallel to each other can be determined in consideration of the inclination angle α of the arm pivot shaft 46, the length and shape of the footrest arm 41, and the like. However, the plate pivot shaft 46 is not necessarily inclined relative to the extension direction of the footrest arm 41. The gap between the right and left footrest plates can be constant along the entire their opposed edges by designing the shapes of the footrest plate as discussed later.

(Supporting Strip 47)

The footrest 8 shown in FIG. 1 includes the supporting strip 47 for holding user's foot on the footrest plate 42. The illustrated supporting strip 47 is a flexible belt-shaped strip. One end of the supporting strip 47 is coupled to the fore end of the footrest arm 41. Another end is coupled to the interior end of the footrest plate 42 by passing the supporting strip through the slit portion 42C and winding it around the interior end of the footrest plate 42. The supporting strip 47 extends between the fore end of the footrest arm 41 and the interior end of the footrest plate 42, and holds the user's foot on the footrest plate 42 to prevent that the user's foot slips off the footrest plate 42. Since the user can bring user's heel in contact with the supporting strip 47 when putting user's foot on the footrest plate 42, it is possible to prevent that the user's foot slides rearward and slips off the footrest plate 42. The supporting strip 47 may be formed of a hook and loop fastener, or the like, and be detachably coupled to the footrest plate. Alternatively, the supporting strip 47 may extend between the right and left footrest arms 41 so that the single supporting strip 47 can holds user's feet. It is noted that the supporting strip 47 is not essential, and may be omitted.

In the aforementioned footrest 8, as shown in FIG. 6, after the footrest plate 42 is folded from the plate unfolded position to the plate folded position, the footrest arm 41 pivots rearward so that the footrest plate 42 can be accommodated in the accommodation space 18. According to this construction, the footrest arm 41 and the footrest plate 42 can be accommodated in the accommodation space 18, and do not protrude on the front side relative to the front frame portion 13.

In the aforementioned footrest 8, the fore ends of the footrest arms 41 are positioned on the interior side relative to the intersections between the footrest arms 41 and the side frames 1 as viewed in plan view. Accordingly, the gap between the right and left footrest plates 42 can be smaller than the wheelchair described in the background art shown in FIG. 23. For this reason, the possibility can be reduced that user's foot slips off right or left footrest plate 42 through the gap between the footrest plates 42. In addition, since the plate pivot shaft 43, which couples the footrest arm 41 to the side frame 1, is inclined relative to a direction perpendicular to the side frame 1, the footrest arm 41 can be positioned on the exterior side relative to the side frames 1 and stand upright in the arm folded position. Accordingly, the footrest arms 41 do not obstruct the collapsing movement of wheelchair. When the footrest arm 41 is switched to the arm unfolded position, the fore end of the footrest arm 41 moves inward as the footrest arm 41 pivot frontward. Therefore, one action of pivoting the footrest arm 41 to the arm unfolded position can reduce the gap between the right and left footrest plates 42. Additionally, since the interior sides of the footrest plates 42 can be closer even in the case where the right-and-left directional length of the footrest plate 42 is the same as the footrest plate described in the background art, the footrest plates 42 do not occupy large space, and interfere with other members so that the pivot movement is not obstructed when the footrest arms pivot rearward.

(Positioning Stopper 44)

In addition, the wheelchair shown in FIG. 1 includes positioning stoppers 44 which define the pivot movement range of the footrest arms 41. The illustrated footrest arms 41 are coupled to the footrest attachment frame portions 16 through the positioning stoppers 44. The positioning stopper 44 can stop the pivot movement of the footrest arm 41 at predetermined positions corresponding to the arm unfolded position and the arm folded position when the footrest arm 41 pivots in the fore-and-aft direction. The illustrated positioning stopper 44 includes an arm-side bearing portion 44C in its central part. The arm pivot shaft 43 is supported by the arm-side bearing portion 44C. Also, the positioning stopper includes a first stopper portion 44A on the front side relative to the illustrated arm-side bearing portion 44C. The first stopper portion 44A stops the footrest arm 41 at the arm unfolded position. Also, the illustrated positioning stopper 44 includes a second stopper portion 44B which stops the footrest arm at the arm folded position. In the illustrated positioning stopper 44, holding grooves 45 are formed in the first and second stopper portions 44A and 44B, and hold the footrest arm 41. More specifically, in the illustrated positioning stopper 44, first and second holding grooves 45A and 45B are provided which hold the footrest arm 41 in the arm unfolded and folded positions, respectively. The footrest arm 41 can be stopped at the predetermined positions by the positioning stopper 44 by setting the inclination angles of the first and second holding grooves 45A and 45B to proper angles.

As shown in FIG. 2, the first holding groove 45A is inclined at such an angle that its front end positioned downward as viewed in side view. In addition, as shown in FIG. 4, the first holding groove 45A is inclined at such an angle that its front end is positioned inward as viewed in front view. Accordingly, when the footrest arm 41 pivots frontward, the footrest arm 41 can be held with the fore end of the footrest arm 41 being positioned on the interior side of the wheelchair as shown FIG. 5.

Also, as shown in FIG. 2, the second holding groove 45B is inclined at such an angle that its upper end is positioned rearward as viewed in side view. In addition, as shown in FIG. 5, the second holding groove 45B extends in the vertical direction as viewed in front view. Accordingly, as shown in FIG. 4, when the footrest arm 41 pivots rearward, the footrest arm 41 can be held parallel to the front frame portion, in other words, upright.

When the aforementioned holding grooves 45 stop the footrest arm 41 at the arm unfolded or folded position, the footrest arm 41 comes in contact with the interior wall surface which defines the holding groove 45. As a result, the footrest arm 41 can be stably held and immovable in the right-and-left direction in FIGS. 4 and 5.

The aforementioned positioning stopper 44 is fastened to the exterior side of the side frame 1. The central part of the positioning stopper 44 shown in FIG. 1 is coupled to the footrest attachment frame portion 16 by the arm pivot shaft 43. The positioning stopper 44 is fastened by the arm pivot shaft 43 to the footrest attachment frame portion 16. Also, the arm pivot shaft 43 pivotably supports the footrest arm 41, which is arranged in the positioning stopper 44. The front part of the illustrated positioning stopper 44 is coupled to the front frame portion 13. The positioning stopper 44 is stably fastened at a predetermined angle. The central part of the illustrated positioning stopper 44 is coupled to the footrest attachment frame portion 16, which is arranged on the exterior side relative to the front frame portion 13. Accordingly, the front part of the positioning stopper 44 extends inward as viewed in plan view.

However, the shape of the positioning stopper 44 is not limited to this. For example, the positioning stopper 44 can be partially cut out so that the cut-out part of the positioning stopper 44 does not interfere with a part of footrest arm 41 in the pivot movement of the footrest arm 41 between the arm unfolded and folded positions.

(Backrest Sheet 10)

The wheelchair shown in FIG. 1 includes a backrest sheet 10 which is arranged on the back side of the seat 5. The both sides of the backrest sheet 10 are coupled to the right and left vertical frame portions 14. When the side frames 1 are moved and opened in the right-and-left direction, the backrest sheet 10 expands from the loose state into the tensioned state, and serves as a backrest of the user who sits on the seat 5. The backrest sheet 10 is loosen when the side frames 1 approach each other.

(Brake Frame 17)

The brake frame 17 shown in FIG. 1 is an L-shaped plate member. One end of the brake frame 17 is coupled to the central part of the footrest attachment frame portion 16, while another end is coupled to the central part of the middle frame portion. The part from the upper end to the middle of the brake frame 17 shown in FIG. 1 is arranged in the plane of the middle frame portion 15, while the front end part of the brake frame 17 is bent outward and coupled to the central part of the footrest attachment frame portion 16. The brake 37 for applying friction to the driving wheel 3 is coupled to the exterior surface of the brake frame 17.

(Brake 37)

The wheelchair shown in FIG. 1 includes the brakes 37 for stopping the rotation of the driving wheels 3. The brake 37 is arranged on the exterior side of the brake frame 17, which is coupled to the rear part of the footrest attachment frame portion 16, and in front of the driving wheel 3. The illustrated brake 37 includes a control-lever portion 37A which can pivot in the fore-and-aft direction, and a press portion 37B for braking which is operated by the control-lever portion 37A and is pressed onto the surface of the driving wheel 3. When the control-lever portion 37A pivots frontward or rearward, the press portion 37B is brought into press contact with the surface of the driving wheel 3 so that the brake 37 can stop the rotation of the driving wheel 3 and bring the wheelchair to a halt.

(Grip Ring 35)

The wheelchair shown in FIG. 1 includes the grip ring 35 on the exterior surfaces of the driving wheels 3. The grip rings 35 are rings to be manually rotated by the user who sits on the seat 5 for rotating the driving wheels 3, and are fastened to the right and left sides of the wheelchair.

The first embodiment has been described. In the footrest arm 41 of the first embodiment, the arm pivot shafts 43 are inclined relative to a direction perpendicular to the side frames 1 as viewed in front view so that the fore ends of the right and left footrest arms 41 are positioned closer to each other in the arm unfolded position than in the arm folded position. However, the way of approaching the fore ends of the footrest arms to each other is not limited the above way. The following description will describe a second embodiment where the arm pivot shaft is inclined in a direction different from the first embodiment.

Second Embodiment

Figure 8:
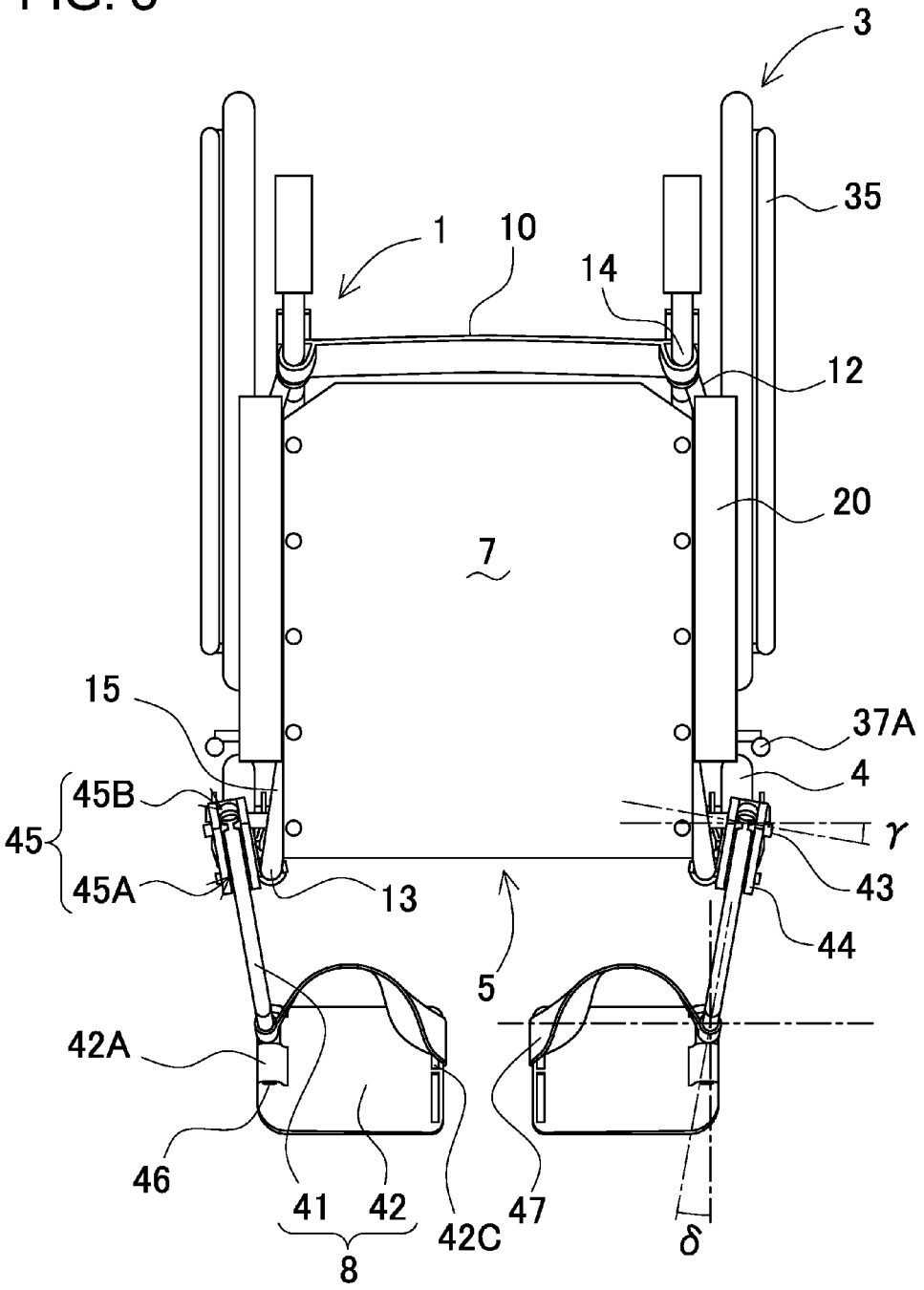
FIG. 8 is a plan view of a wheelchair according to another embodiment of the present invention.

FIG. 8 is a plan view of a wheelchair according to a second embodiment. In the illustrated wheelchair, the footrest arms 41 are coupled to the exterior sides of the side frames 1 through the arm pivot shafts 43. The footrest arm 41 can be switched between the arm folded and unfolded positions.

(Arm Pivot Shaft 43)

The arm pivot shaft 43 is inclined in the horizontal plane of the wheelchair as shown in the plan view of FIG. 8. The illustrated arm pivot shaft 43 is inclined so that one of the both ends of the arm pivot shaft, which is located on the exterior side of the wheelchair, is positioned on the front side relative to another end, which is located on the interior side of the wheelchair. The angle of the arm pivot shaft 43 relative to a direction perpendicular to the side frame 1 is defined as an inclination angle $\gamma$. The inclination angle $\gamma$ falls within the range from 1° to 30°. The inclination angle $\gamma$ preferably falls within the range from 5° to 20°. The inclination angle $\gamma$ more preferably falls within the range from 10° to 15°. In the case where the inclination angle $\gamma$ falls within the range from 10° to 15°, when the footrest arms 41 pivot to the arm unfolded position, the footrest plates 42, which are coupled to the fore ends of the right and left footrest arms 41, can be sufficiently close to each other but the distance between the right and left footrest arms 41 can be not too small so that sufficient space can be provided for the footrest plates 42. Although not illustrated, the arm pivot shaft 43 lies in the horizontal plane.

(Plate Pivot Shaft 46)

Similar to the first embodiment, the axis of the plate pivot shaft 46 is inclined toward the fore-and-aft direction of the wheelchair from the extension direction of the footrest arm 41. The angle of the plate pivot shaft relative to the extension direction of the footrest arm 41 is defined as the inclination angle $\delta$. The inclination angle $\delta$ falls within the range not greater than 30°, for example. It is preferable that the inclination angle $\delta$ is designed equal to the inclination angle $\gamma$. The reason is that the opposed edges of the right and left footrest plates 42 can be orientated parallel to each other by designing the angle γ equal to the angle δ so that the gap between the footrest plates 42 can be fixed along the opposed edges. Also, the right and left footrest plates can be aligned so that the footrest plates are not inclined frontward or rearward. As a result, user's feet can be stably supported by the footrests.

In the illustrated wheelchair, since the arm pivot shaft 43 is inclined, the fore end of the footrest arm 41 extends toward the interior side of the wheelchair when the footrest arm 41 is brought into the arm unfolded position. Accordingly, the footrest plates 42, which are coupled to the fore ends of the right and left footrest arms 41, can be close to each other similar to the first embodiment. As a result, according to the wheelchair of the second embodiment, since the gap between the right and left footrest plates 42 is small, the possibility can be effectively reduced that user's foot slips off right or left footrest plate through the gap when the user sitting down in the seat space of the wheelchair.

Figure 9:
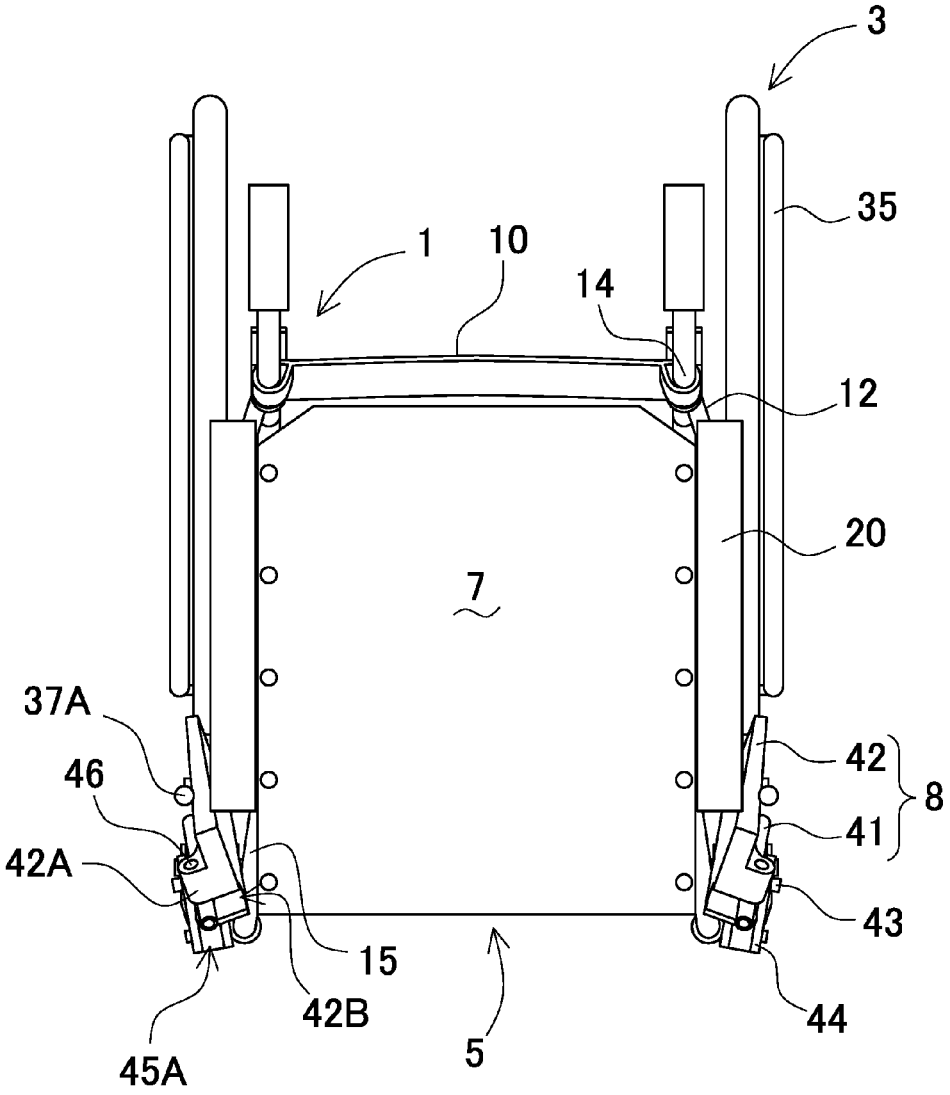
FIG. 9 is a plan view showing the wheelchair of FIG. 8 with its footrest arms brought in an arm folded position.

FIG. 9 is a plan view showing the wheelchair of FIG. 8 with the footrest arms 41 brought in the arm folded position. In the illustrated footrest arm 41, since the arm pivot shaft 43 is inclined in the fore-and-aft direction of the wheelchair, the footrest arm 41 can be positioned on the exterior side of the vertical plane of the side frame 1 in the arm folded position. According to this construction, the footrest arms 41 or the footrest plates 42 do not reduce the space above the seat when the footrest arm 41 pivots to the arm folded position. In addition, the right and left footrest arms 41 and the footrest plates 41 will not interfere with each other when the side frames 1 are moved to approach each other to collapse the wheelchair.

Although not illustrated, a wheelchair according to the second aspect of the present invention, the arm pivot shaft can be inclined so that one end of the arm pivot shaft, which is located on the exterior side of the wheelchair, is positioned higher than another end, which is located on the interior side of the wheelchair, as viewed in front view. Even if the arm pivot shaft is inclined, the fore end of the footrest arm can be positioned on the interior side relative to the side frame in the arm unfolded position by setting the angle of the footrest arm relative to the arm pivot shaft to a proper angle. In the wheelchair according to the second embodiment, in the case where the footrest arm 41 is coupled at a right angle to the arm pivot shaft 43, a force can be uniformly applied the footrest arm 41 to the arm pivot shaft 43 over the intersection between the footrest arm 41 and the arm pivot shaft 43. As a result, it is possible to ensure sufficient strength of the arm pivot shaft 43.

In the first and second embodiments, the arm pivot shaft is inclined relative to the direction perpendicular to the side frame as viewed in plan or front view. However, the arm pivot shaft may be inclined relative to the direction perpendicular to the side frame as viewed both in plan and front views, although not illustrated. In the case where the arm pivot shaft is inclined both in the vertical direction and the fore-and-aft direction, even if the inclination angles of the arm pivot shaft in the vertical direction and the fore-and-aft direction are small, the fore end of the footrest arm can be positioned further inside in the arm unfolded position.

(Modified Embodiment 1)

The wheelchairs according to the first and second embodiments have been described. However, the way of reducing the gap between the right and left footrest plates in the plate unfolded position of the footrest plate is not limited to these. In the foregoing embodiments, even in the case where the footrest plates 42 has a roughly rectangular shape, the right and left plate pivot shafts 46 are inclined relative to the extension direction of the footrest arm 41 so that the opposed edges of the right and left footrest plates 42 are parallel to each other, and the gap between the opposed edges is constant. In a wheelchair according to a modified embodiment, the plate pivot shafts 46*a* are parallel to the extension direction of the footrest arms 41 but the opposed edges of the footrest plates 42 are parallel to each other, and the gap between the opposed edges is constant.

Figure 10:
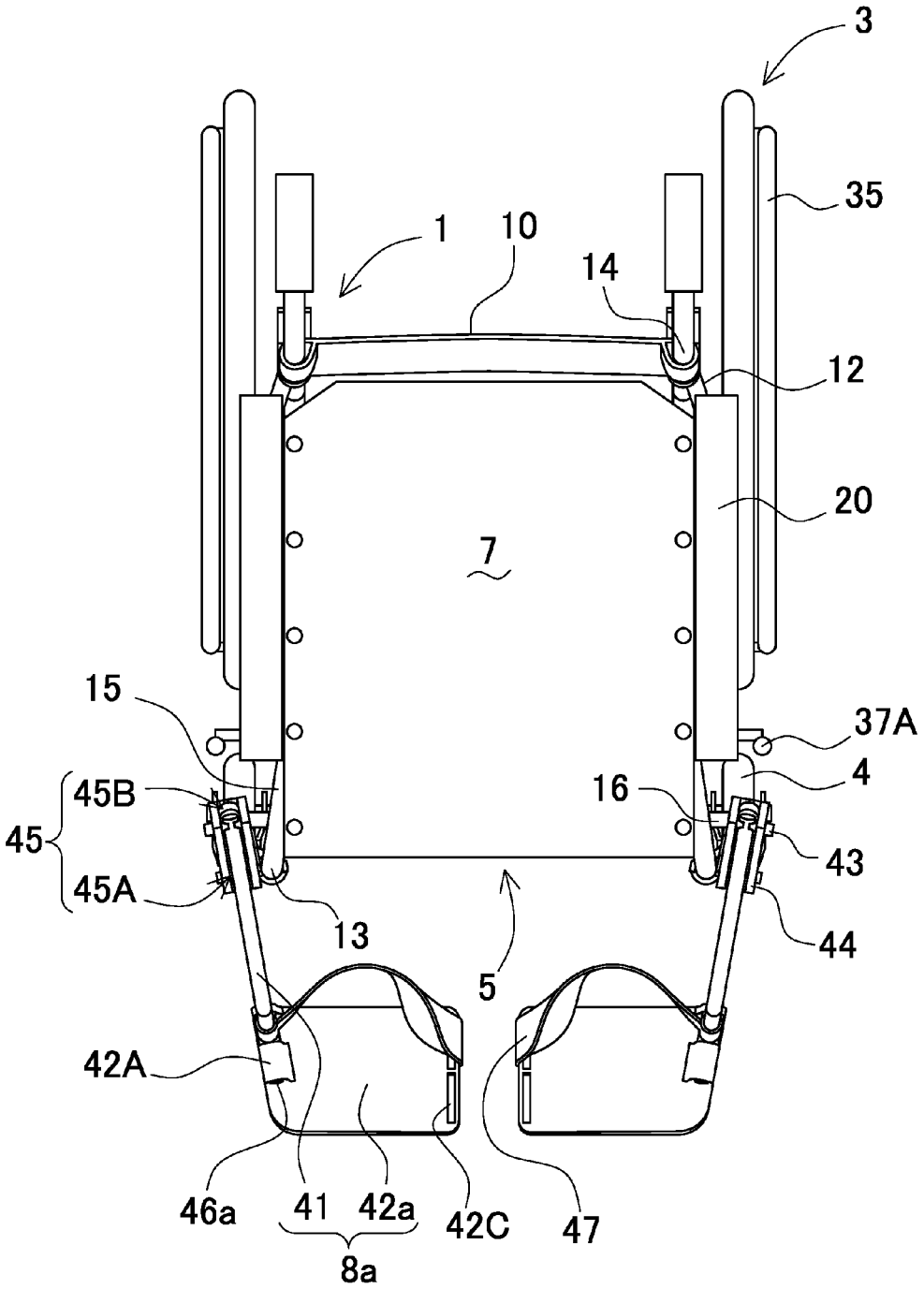
FIG. 10 is a plan view showing a modified embodiment of the present invention.

FIG. 10 is a plan view of the wheelchair according to this modified embodiment. Plate pivot shafts 46*a* for a footrest 8*a* of the wheelchair shown in FIG. 10 are provided parallel to the extension direction of the footrest arms 41. The base end of the footrest plate 42*a* is coupled at the fore end of this footrest arm 41. The illustrated footrest plate 42*a* has a roughly trapezoidal shape as viewed in plan view. The base end edge of the illustrated footrest plate 42*a* is parallel to the plate pivot shaft 46. The interior ends of the illustrated footrest plates 42*a*, more specifically, the opposed edges of the right and left footrest plates 42*a* are parallel to each other. The other two edges of the footrest plate 42*a*, which connect the interior end to the base end, are parallel to each other, and perpendicular to the interior end. Since the footrest plates 42*a* has the aforementioned trapezoidal shape, even though the plate pivot shaft 46*a* is parallel to the extension direction of the footrest arm, the opposed edges of the footrest plates 42*a* can be parallel to each other, and it is possible to prevent increase of the gap between the right and left opposed edges.

The wheelchair of the modified embodiment 1 has been described. However, the shape of the footrest plate is limited to neither rectangular shape nor trapezoidal shape. For example, the opposed edge of the footrest plate may have a curved, convex shape in its central part, or the like. In this case, although the space between the opposed edges is large other than the central parts of the right and left footrest plates, which are the closest parts to each other, a part of the space between the opposed edges can be small. As a result, it is possible to prevent that user's foot slips off the footrest plate. In addition, in the case where the opposed edge of the footrest plate has a curved shape, the interference can be prevented between the supporting strips, which are arranged on the interior ends of the footrest plates.

(Modified Embodiment 2)

It has been described that the right and left footrest plates 42 of the wheelchair according to the first and second embodiments are close to each other but spaced away from each other as shown in the front view of FIG. 5. Contrary to this, in a wheelchair according to a modified embodiment 2, the opposed edges of right and left footrest plates are not spaced away from each other but can contact each other so that the gap between the footrest plates is completely closed. The following description will describe the modified embodiment 2.

(Footrest Plate 42*b*)

Figure 11:
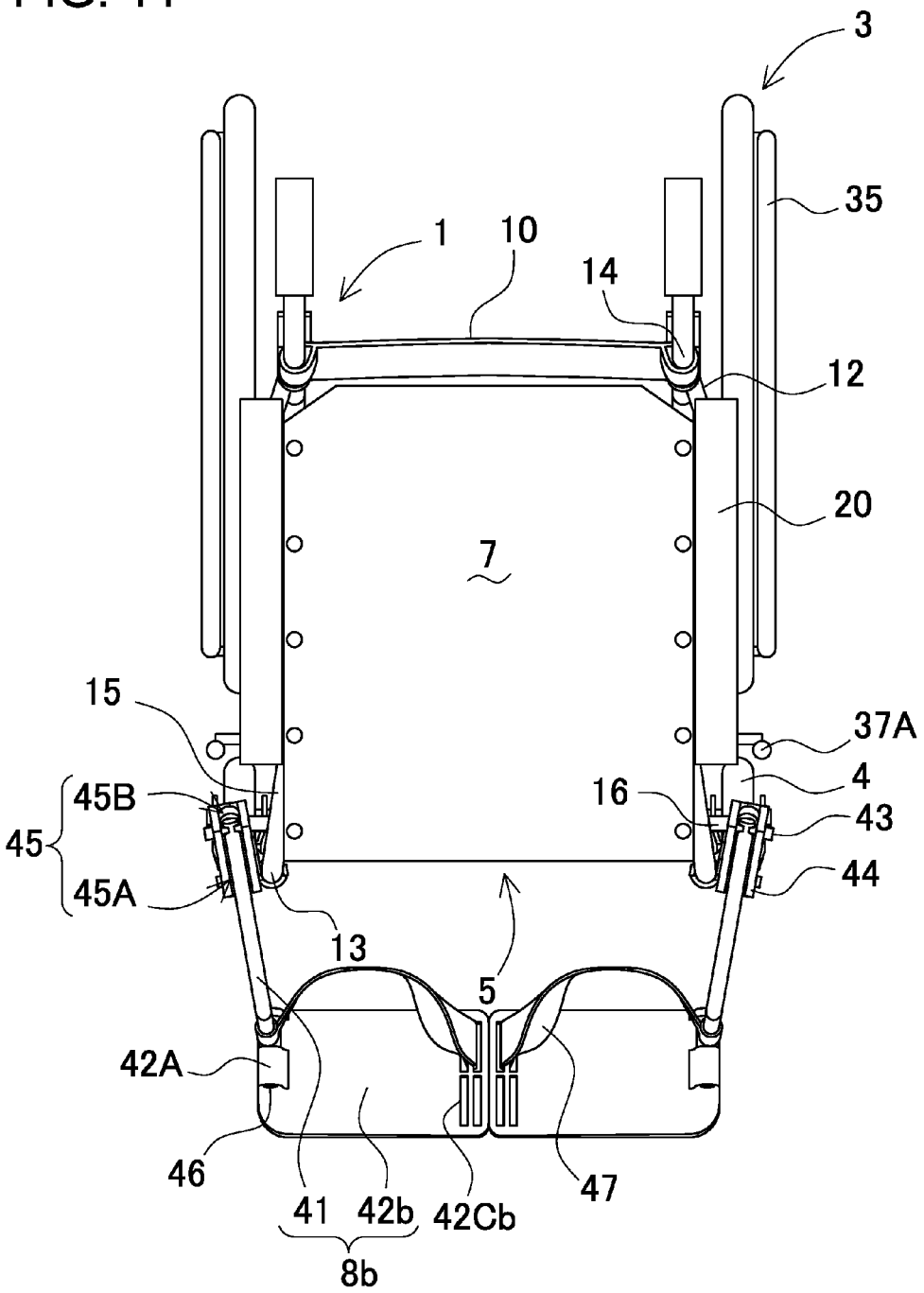
FIG. 11 is a plan view showing another modified embodiment of the present invention.

In the footrests 8*b* of the wheelchair according to the modified embodiment 2, as shown in a plan view of FIG. 11, when the footrest arms 41 are brought in the arm unfolded position, the gap between the right and left footrest plates 42*b* is completely closed. Since the gap between the footrest plates 42*b* is closed, the possibility can be eliminated that user's foot slips off right or left footrest plate 42*b* through the gap. In addition, hook and loop fastener components (not shown) are provided on the opposed parts of the right and left supporting strips, which are provided on the right and left footrest plates 42*b*. The right and left footrest plates 42*b* can be coupled to each other by the hook and loop fastener components.

The footrest plates 42*b* shown in FIG. 11 have slits 42Cb which can be arranged side by side on the parts that are located slightly on the exterior side from the interior ends of the footrest plates. The supporting strips 47 pass through the slits 42Cb. According to this arrangement, the supporting strips 47 do not protrude from the interior ends of footrest plates 42Cb. As a result, the pivot movement is not obstructed which is caused by interference between the supporting strips 47 on the interior ends of the footrest plates 42*b* with each other.

In order to eliminate the gap between the footrest plates 42*b* as shown in FIG. 11, the length of the footrest plate 42*b* from the interior end to the base end is dimensioned. Alternatively, the inclination angle α of the arm pivot shaft can be set in order to achieve the elimination of the gap.

(Modified Embodiment 3)

In addition to the elimination of the gap between the right and left footrest plates 42 as in the modified embodiment 2, a wheelchair according to a modified embodiment 3 of the present invention includes engagement portions that are arranged on the interior ends of the footrest plates and can engage with each other. The following description will describe the modified embodiment 3.

(Footrest Plate 42*c*)

The wheelchair of the modified embodiment 3 includes footrests 8*c* which have footrest plates 42*c*. The footrest plates 42*c* have first and second engagement portions 51 and 52 in their interior end parts as shown in the front view of FIG. 12. The first and second engagement portions 51 and 52 can engage with each other. The right and left footrest plates 42*c* can be coupled to each other in the plate unfolded position of the footrest plate 42*c* by the engagement between the first and second engagement portions 51 and 52. According to this construction, even when a lateral force is applied to the footrest arm 41 or the footrest plate 42*c* or the wheelchair is subjected to vibration, the connection between the right and left footrest plates 42*c* can be maintained by the first and second engagement portions 51 and 52. As a result, the possibility can be effectively prevented that space is unexpectedly created between the footrest plates 42, which causes user's foot slip off right or left footrest plate through the created space.

In order to eliminate the gap between the footrest plates 42*c*, the length of the footrest plate from the interior end to the base end is increased from the length of the footrest plate 42*b*. Alternatively, the inclination angle α of the arm pivot shaft can be increased in order to achieve the elimination of the gap.

Figure 12:
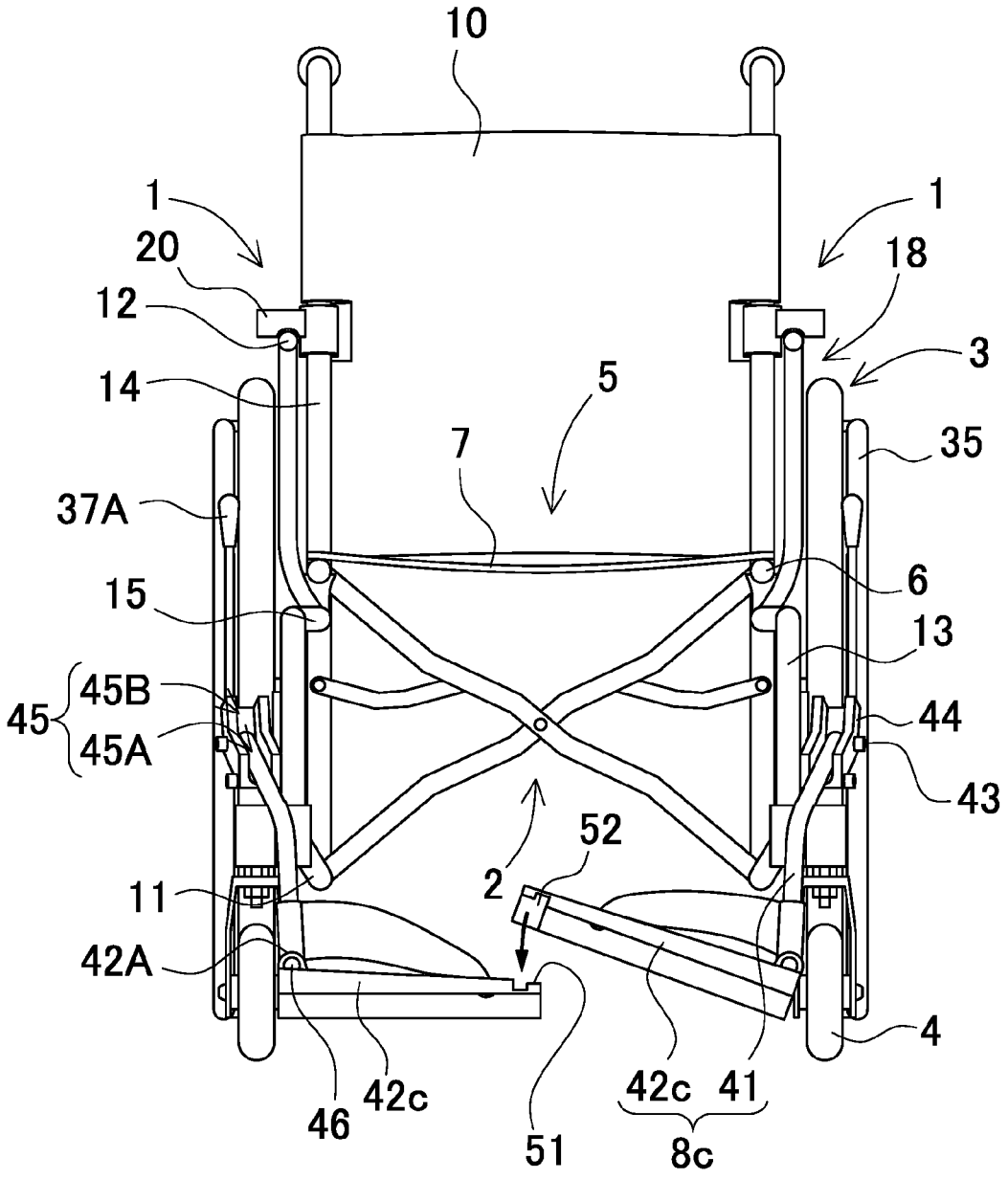
FIG. 12 is a front view showing the another modified embodiment of the present invention.

The wheelchair of the modified embodiments 1 to 3 have been described. It is noted that although the wheelchairs according to the modified embodiments 1 to 3 have been described with reference to FIGS. 10 to 12 showing that the arm pivot shaft 43*a* is inclined in the horizontal plane as viewed in plan view as in the second embodiment, the modified embodiments 1 to 3 can be applied to the wheelchair according to the first embodiment. In addition, although the wheelchairs according to the modified embodiments 1 to 3 have been independently described, the modified embodiment 1 can be combined with the modified embodiment 2 or 3.

Third Embodiment

The first and second embodiments, and the modified embodiments 1 to 3 applied to the embodiments have been described which include the arm pivot shafts inclined relative to the side frames in order to reduce the gap between the right and left footrest plates. The following description will describe a third embodiment which includes footrests 8*d* having rotation portions 64 to allow parts of footrest arms to rotate in order to reduce the gap between the right and left footrest plates.

(Footrest Arm 61)

Figure 13:
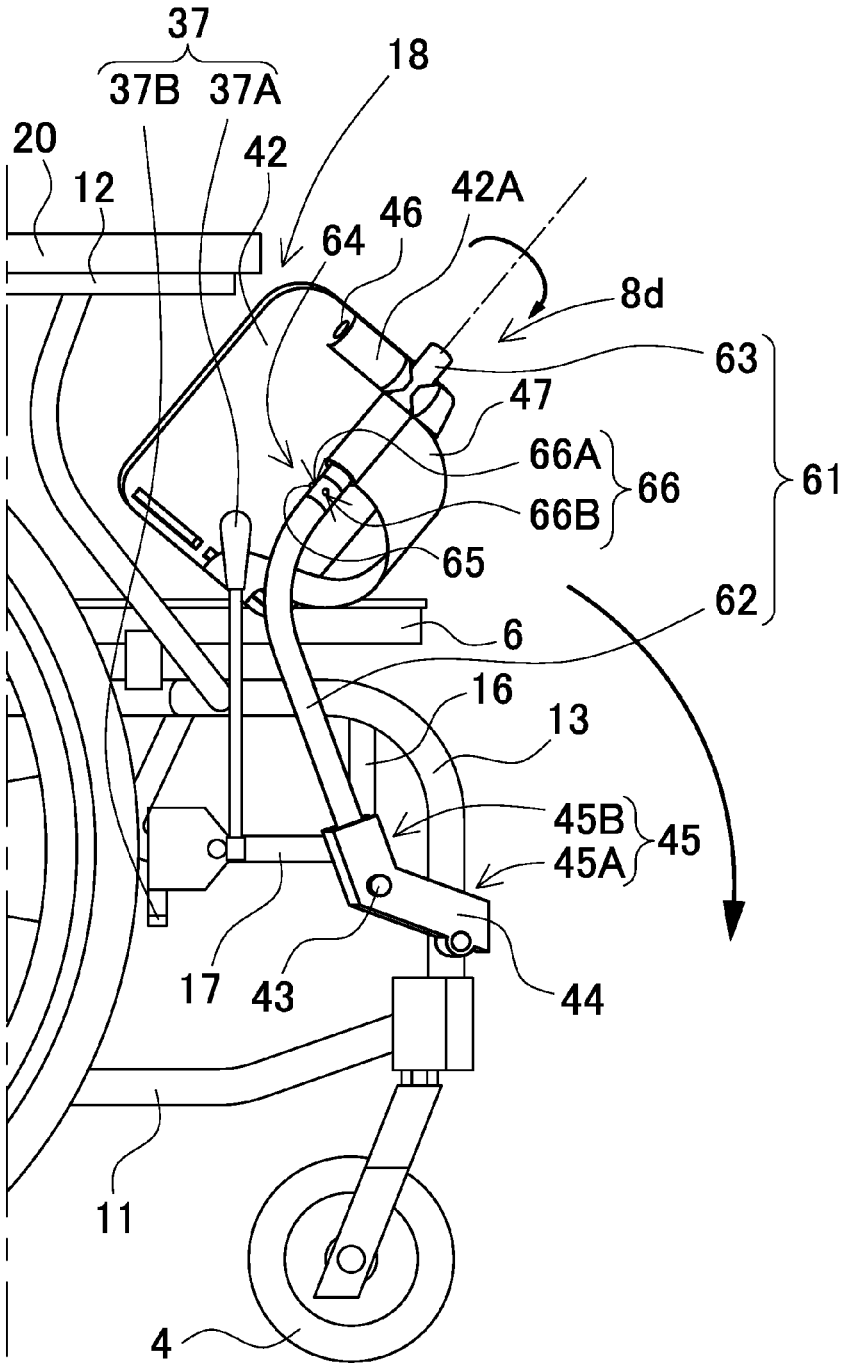
FIG. 13 is an enlarged view showing the essential part of a wheelchair according to another embodiment of the present invention.
Figure 14:
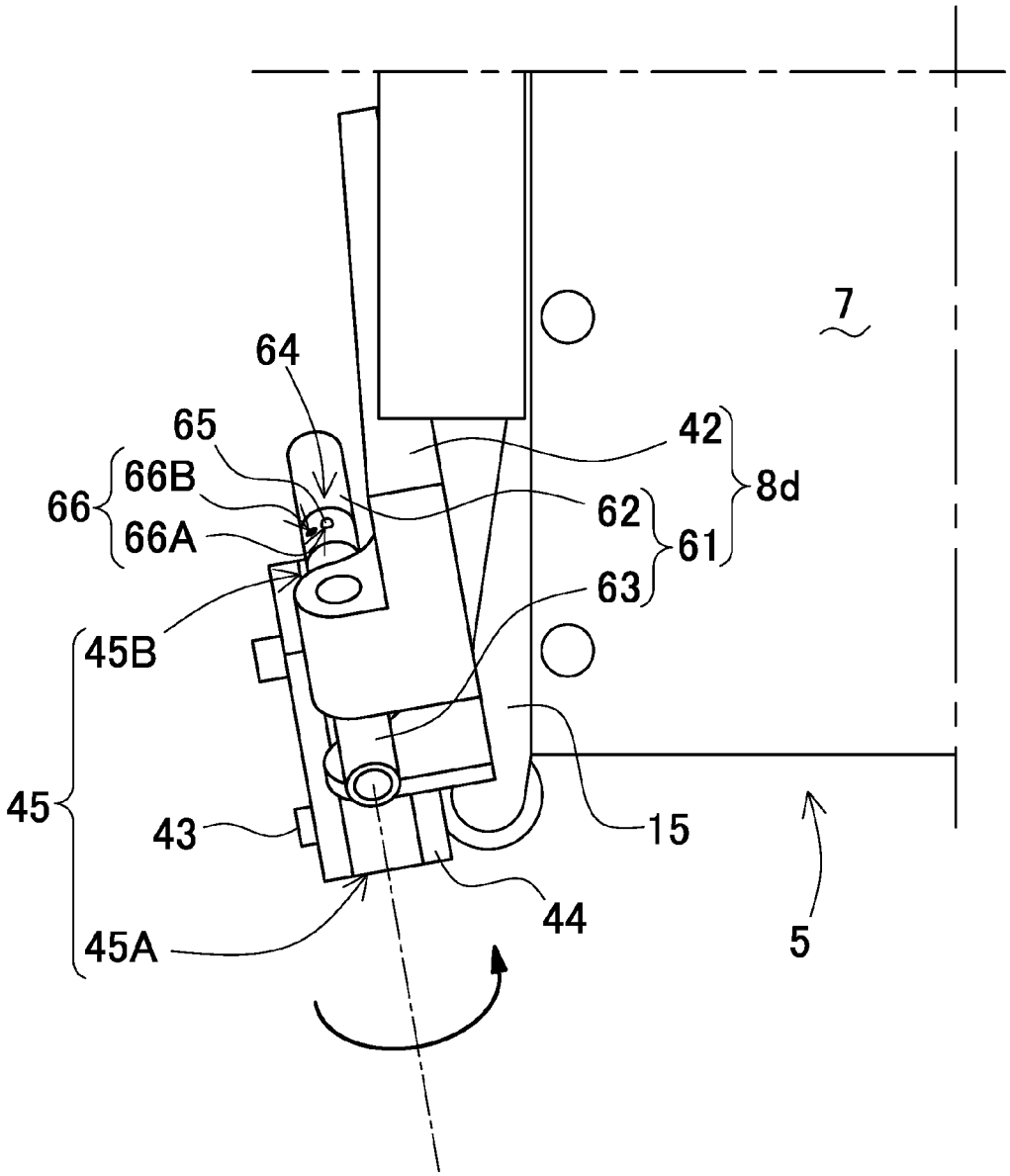
FIG. 14 is a plan view of the wheelchair shown in FIG. 13.

FIGS. 13 and 14 are enlarged views showing the essential part of a wheelchair according to a third embodiment of the present invention. FIG. 13 is a side view of the essential part of the wheelchair according to the third embodiment. FIG. 14 is a plan view of the essential part of the wheelchair shown in FIG. 13. Each of the footrests 8*d* of the wheelchair according to the third embodiment includes a footrest arm 61 which has first and second arm portions 62 and 63 coupled to each other. The rotation portion 64 is arranged on the fore end of the illustrated first arm portion 62. The rear end of the second arm portion 63 is coupled to the fore end of the first arm portion 62 through the rotation portion 64. The base end of the footrest arm 61 is pivotably coupled through the arm pivot shaft 43 to the exterior side of the footrest attachment frame portion 16 of the side frames 1 of the wheelchair. The footrest arm pivots about the arm pivot shaft 43 frontward and rearward, and can be switched between the arm unfolded position where it pivots frontward and the arm folded position where it pivots rearward. The arm pivot shaft 43 is inclined relative to a direction perpendicular to the side frame 1 as viewed in plan view. In addition, in the arm unfolded position of the footrest arm 61, the fore end of the footrest arm 61 is positioned on the interior side relative to the base end of the footrest arm 61, which is coupled to the side frame 1. Also, the inclination angle of the arm pivot shaft 43 relative to the side frame 1 falls within the range 1° to 30°, preferably 5° to 20°, and more preferably 10° to 15°.

(First Arm Portion 62)

In order that the footrest arm 61 can pivot in the vertical plane containing the fore-and-aft direction when folded, the base end part of the first arm portion 62 is coupled to the exterior surface of the footrest attachment frame portion 16 by the arm pivot shaft 43. The illustrated first arm portion 62 is curved so that its fore end extends downward in the arm unfolded position of the footrest arm 61. The rotation portion 64 is arranged on the fore end of the first arm portion 62, and rotatably couples the second arm portion 63 to the first arm portion 62. The fore end of the first arm portion 62 is coupled to the rear end of the second arm portion 63 through the rotation portion 64.

(Second Arm Portion 63)

The rear end of the second arm portion 63 shown in FIG. 13 is coupled to the rotation portion 64, which is arranged on the fore end of the first arm portion 62, so that the second arm portion 63 can rotate about the first arm portion 63. Also, the footrest plate 42 is pivotably coupled to the fore end of the second arm portion 63 through the plate pivot shaft 46.

(Rotation Portion 64)

Figure 15:
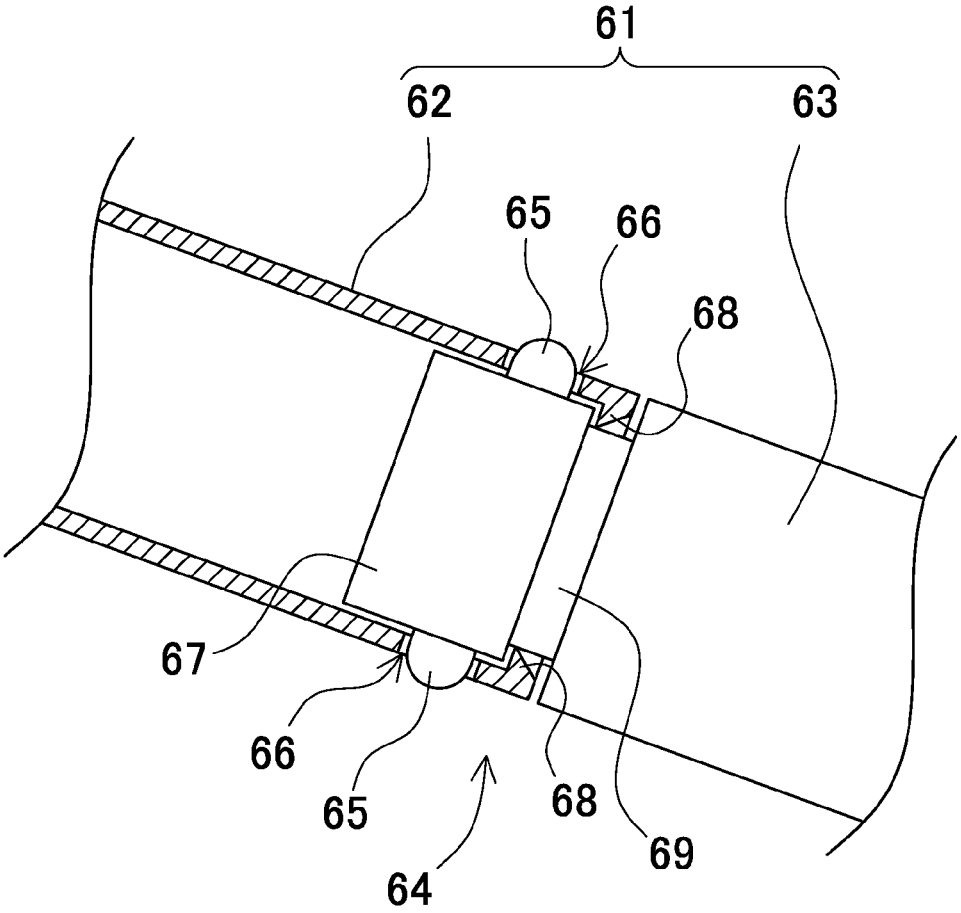
FIG. 15 is an enlarged cross-sectional view showing the essential part of a footrest arm according to the another embodiment of the present invention.

FIG. 15 is an enlarged cross-sectional view showing the essential part of the footrest arm 61. The rear end of the second arm portion 63 is coupled to the fore end of the first arm portion 62 through the rotation portion 64 in the footrest arm 61 shown in FIG. 15. The illustrated rotation portion 64 couples the second arm portion 63 to the first arm portion 62 so that the second arm portion 63 can rotate about the first arm portion 62 as the rotation axis. An annular groove 69 is formed on the rear end part of the second arm portion 63 in the illustrated footrest arm 61. A hook portion 68 is formed on the fore end of the illustrated first arm portion 62, and is held in the groove 69. The second arm portion 63 is coupled to the first arm portion 62 by the hook portion 68 held in the groove 69, and can rotate about the first arm portion 62. In addition, the second arm portion 63 includes a shaft part 67 which is arranged inside the first arm portion 62, and holds push buttons 65. The push button 65 can be retracted into the shaft part 67 when an external force is applied from the outside to the push button 65 in a direction perpendicular to the second arm portion 63. A coil spring (not shown), leaf spring (not shown, or the like, is arranged inside the shaft part 67, and supports the push button 65. When the external force is released, the push button 65 returns to the original position outside the shaft part 67. Holding apertures 66 are formed in the fore end part of the illustrated first arm portion 62. The push buttons 65 can be inserted into the holding apertures 66 so that the second arm portion 63 is held at predetermined angles. First and second holding apertures 66A and 66B are provided as the holding apertures 66. Two sets of the push buttons 65 and the holding apertures 66 are arranged at opposite positions in FIG. 15. However, the push buttons 65 and the holding apertures 66 are not necessarily arranged at the opposite positions. For example, only one set of the push button 65 and the holding aperture 66 may be arranged for each of the first and second holding apertures 66A and 66B.

(Rotational Movement of Second Arm Portion 63)

When the second arm portion 63 is rotated about the first arm portion 62, the footrest plate 42 of the footrest arm 61, which is coupled to the fore end of the second arm portion 63, can pivot, in other words, the angle of the footrest plate 42 can be changed. In this embodiment, in the case where the footrest arms 61 are brought in the arm unfolded position, in order that the footrest plates 42 can support user's feet, when the second arm portions 63 are rotated so that the opposed edges of the footrest plates 42 extend parallel to each other in the plate unfolded position, even though the right and left plate pivot shafts 46 are parallel to each other, the right and left footrest plates 42 are aligned with each other similar to the wheelchair according to the first embodiment shown in FIG. 5. As a result, the gap between the right and left footrest plates 42 can be constant along the entire their opposed edges, and the possibility can be reduced that user's foot slips off right or left footrest plate 42 through the space between the footrest plates 42. In this rotational movement of the second arm portion 63, when the push button 65 is inserted into the second holding aperture 66B so that the second arm portion 63 is held at one of the predetermined angles. FIG. 14 is an enlarged view showing the essential part of the wheelchair shown in FIG. 13. Here, some members of the illustrated wheelchair shown in FIG. 13 are omitted in FIG. 14 for the sake of clarity of the footrest 8*d*. In this wheelchair, when the footrest plate 42 is accommodated in the accommodation space 18, as shown in FIGS. 13 and 14, the second arm portion 63 can be rotated so that the footrest plate 42 extends parallel to a plane perpendicular to the pivot direction of the footrest arm 61. When the push button 65 is inserted into the first holding aperture 66A, the illustrated second arm portion 63 is held at another predetermined angle. The occupied area of the footrest plate 42 in a direction perpendicular to the side frame 1 can be reduced as viewed in plan view. As a result, the wheelchair can be more compact when collapsed.

The aforementioned modified embodiment 2 or 3 can be applied to this third embodiment, that is, the case where the opposed parts of the right and left footrest plates 42 can be in contact with each other in the third embodiment.

According to the wheelchair of the foregoing the first to third embodiments, the arm pivot shafts are inclined relative to a direction perpendicular to the side frames so that the opposed parts of the footrest plates are positioned close to or in contact with each other. Therefore, the possibility can be reduced or eliminated that user's foot slips off right or left footrest plate through the space between the footrest plates. The following description will describe another embodiment in which although the arm pivot shafts are coupled perpendicular to the side frames the possibility can be reduced or eliminated that user's foot slips off right or left footrest plate through the space between the footrest plates.

Fourth Embodiment

Figure 16:
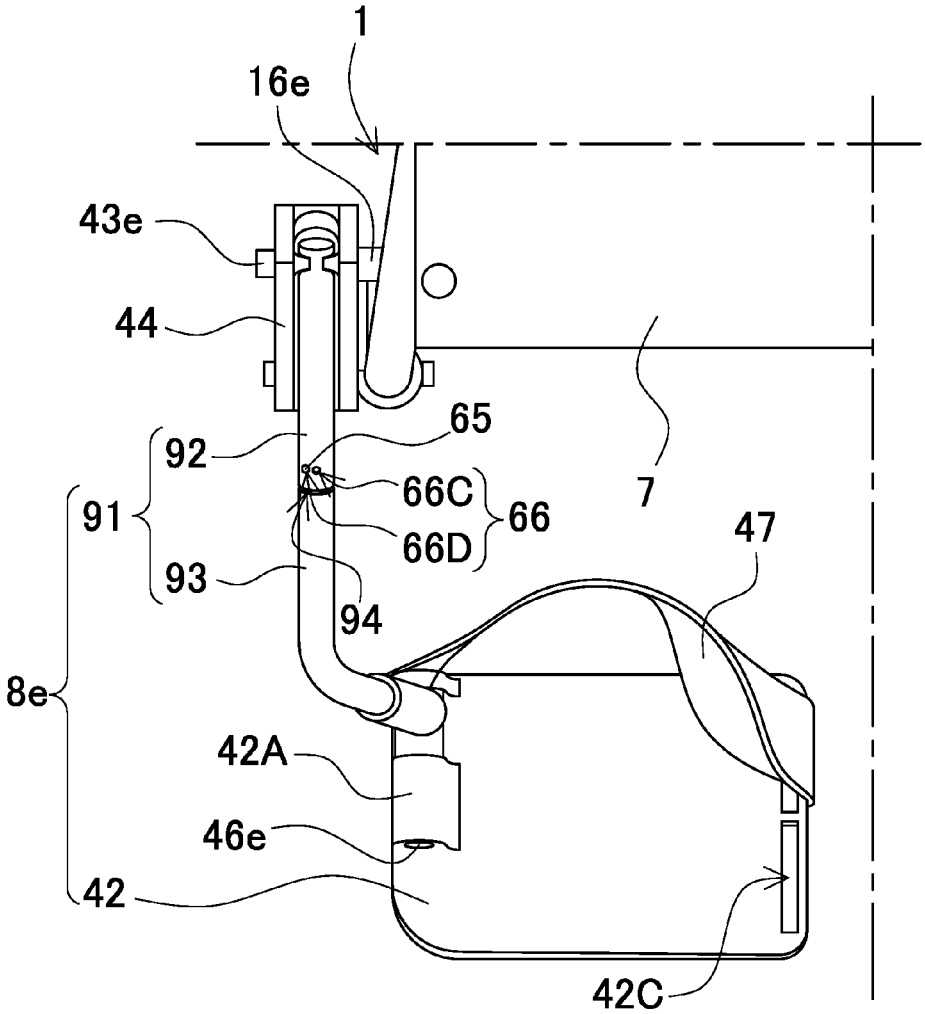
FIG. 16 is an enlarged view showing the essential part of a wheelchair according to another embodiment of the present invention.
Figure 17:
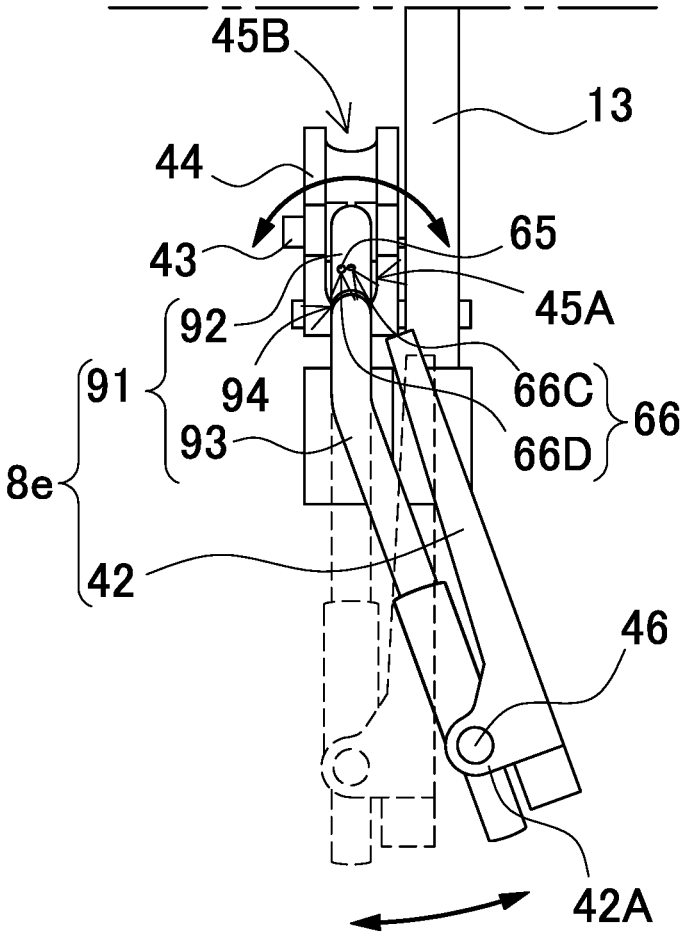
FIG. 17 is a front view of the wheelchair shown in FIG. 16.

FIG. 16 is an enlarged view showing the essential part of a wheelchair according to a fourth embodiment. FIG. 16 shows a footrest 8*e* of the wheelchair according to the fourth embodiment. FIG. 17 is a front view of the footrest 8*e* shown in FIG. 16. Here, some members of the wheelchair shown in Figures of the first to fourth embodiments are omitted in FIGS. 16 and 17 for the sake of clarity of the footrest 8*e*.

Each of the footrests of the wheelchair shown in FIG. 16 includes a footrest arm 91, which is coupled to the exterior surface of the side frame 1, and the footrest plate 42, which is pivtably coupled to the fore end of the footrest arm 91. The footrest arm 91 of the wheelchair shown in FIG. 16 is coupled through the arm pivot shaft 43*e* to a footrest attachment frame portion 16*e* which lies in the vertical plane of the side frame 1. An arm pivot shaft 43*e* shown in FIG. 16 extends perpendicularly to the side frame. In the case where the footrest arm is brought in the arm unfolded position where it pivots frontward, when the footrest plate 42 is brought in the plate unfolded position where its the upper surface lies in a plane substantially perpendicular to the footrest arm 91, the footrest 8*e* shown in FIG. 16 can support user's foot on the upper surface of the footrest plate 42.

(Footrest Arm 91)

The footrest arm 91 includes first and second arm portions 92 and 93 coupled to each other. The rotation portion 94 is arranged on the fore end of the illustrated first arm portion 92 of the illustrated footrest arm 91. The rear end of the second arm portion 93 is coupled to the base end of the first arm portion 92 through the rotation portion 94. The base end of the first arm portion 92 of the footrest arm 91 shown in FIG. 16 is pivotably coupled to the exterior surface of the side frame 1 frontward and rearward in the vertical plane. The footrest plate 42 is coupled to the fore end of the second arm portion 93 shown in FIG. 16, and can be switched between the plate unfolded and folded positions. The first arm portion 92 of the footrest arm 91 shown in FIG. 16 is formed straight. The central part of the second arm portion 93 is curved so that its fore end extends downward in the arm unfolded position of the footrest arm 91. The second arm portion 93 can rotate about the first arm portion 92 as the rotation axis. As shown in FIG. 16, in order to unfold the footrest plates 42, the fore ends of the second arm portions pivot inward so that the opposed edges of the right and left footrest plates approach each other.

FIG. 17 is a front view of the footrest shown in FIG. 16 with the footrest plate 42 brought in the plate folded position. The second arm portion 93 of the footrest arm 91 shown in FIG. 17 can be rotated about the first arm portion 92 so that the entire footrest arm 91 stands upright as shown by the dashed lines. Since the entire footrest arm 91 can stand upright, when the footrest arm 91 pivots rearward as viewed in plan view, the footrest arm 91 and the footrest plate 42 do not protrude from the accommodation space 18 provided between the elbow rest frame portion 12 and the middle frame portion 15. Therefore, the illustrated footrest 8*e* can be compact when folded.

(First Arm Portion 92)

The base end of the first arm portion 92 shown in FIG. 16 is coupled to the exterior surface of the footrest attachment frame portion (not shown) through the arm pivot shaft 43*e*. The first arm portion 92 shown in FIG. 16 is a linear member. The rotation portion 94 is arranged on the fore end of the first arm portion 92. The first arm portion 92 is coupled to the rear end of the second arm portion through the rotation portion 94.

(Second Arm Portion 93)

The rear end of the second arm portion 93 is coupled to the fore end of the first arm portion 92 through the rotation portion 94 shown in FIG. 16. In addition, the footrest plate 42 is coupled to the fore end of the second arm portion 93 shown in FIG. 16 through the plate pivot shaft 46*e*. The plate pivot shaft 46*e* extends parallel to the side frame 1. When the footrest is used, the second arm portion 93 is rotated about the first arm portion 92 so that the fore end of the second arm portion 93 is positioned inward as shown in FIG. 16. As a result, the right and left footrest plates 42 approach each other. Therefore, the possibility can be effectively reduced that user's foot slips off right or left footrest plate 42 through the space between the footrest plates 42. In addition, as shown in FIG. 17, in order to fold the footrest 8*e*, the second footrest arm portion 93 is rotated about the first arm portion 92 so that the front part of the second footrest arm portion 93 extends upward relative to the bent portion of the second footrest arm portion 93. Accordingly, the entire footrest arm 91 stands upright. As a result, when pivoting rearward to be folded, the footrest arm 91 can be more compact when folded.

(Rotation Portion 94)

The second arm portion 93 is coupled to and can pivot about the first arm portion 92 through the rotation portion 94 in the footrest arm 91 shown in FIG. 16. The rotation portion 64, which couples the first arm portion 62 in the third embodiment and the second arm portion 93 shown in FIG. 15, can be used as the rotation portion 94. The illustrated rotation portion 94 includes the push buttons 65, and the holding apertures 66. The push button 65 can hold the second arm portion 93 at a predetermined position. The push button 65 can be inserted into the holding aperture 66. First and second holding apertures 66C and 66D are provided as the holding apertures 66. The first holding aperture 66C holds the second arm portion so that the footrest arm 91 stands upright as a whole as shown in FIG. 17. The second holding aperture 66D holds the second arm portion 93 so that the fore end of the second arm portion 93 positioned inward as viewed in plan view as shown in FIG. 16. When the footrest is used or folded the second arm portions 93 can be held in the corresponding predetermined position by the push buttons 65 and the holding apertures 66.

The wheelchair of the fourth embodiment has been described. The arm pivot shaft of the wheelchair of this fourth embodiment extends a direction perpendicular to the side frame dissimilar to the wheelchair according to the first to fourth embodiments. The modified embodiment 2 or 3 of the first embodiment can be applied to the fourth embodiment so that the interior ends of the right and left footrest plates can come into contact with each other, or the engagement portions which engage with each other are provided in the interior ends of the right and left footrest plates.

Fifth Embodiment

Figure 18:
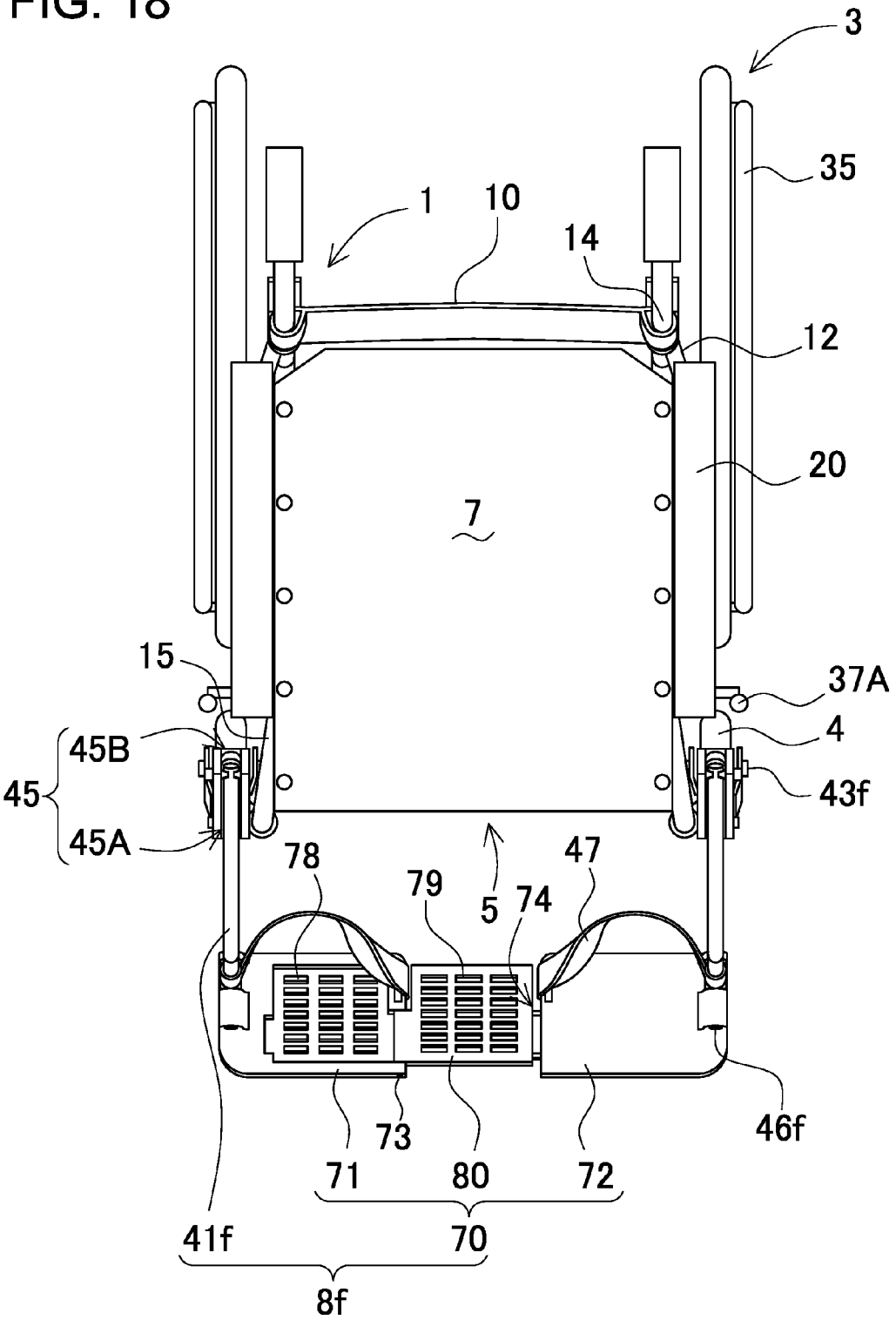
FIG. 18 is a plan view of a wheelchair according to another embodiment of the present invention.

FIG. 18 is a front view of a wheelchair according to fifth embodiment. Footrest equipment 8*f* of the wheelchair shown in FIG. 18 includes footrest arms 41*f*, which are coupled parallel to the side frames to the exterior surfaces of the side frames 1, and a footrest plate set 70, which is pivotably coupled to the fore ends of the footrest arms 41. This footrest plate set 70 includes right and left footrest plates 71 and 72, and a central plate 80 which bridges the gap between the footrest plates. The central plate 80 can support user's foot on its main surface. Since the central plate bridges the gap between the footrest plates 71 and 72, the possibility can be effectively reduced that user's foot slips off right or left footrest plate 71 or 72 through the space between the footrest plates 71 and 72.

Each of the side frames 1 of the wheelchair of FIG. 18 includes the middle frame portion 15, and the front frame portion 13 which extends downward from the front part of the middle frame portion 15. In addition, each of the side frames 1 includes the footrest attachment frame portion (not shown) which is arranged in the corner part defined by the front part of the middle frame portion 15, and upper part of the front frame portion 13. The footrest attachment frame portion lies in the vertical plane where the middle and front frame portions 15 and 13 lie. The footrest arm 41*f* is coupled to the exterior surface of the footrest attachment frame portion.

(Footrest Arm 41*f*)

In this wheelchair, the footrest arms 41*f* are coupled to the exterior sides of the footrest attachment frame portion through of arm pivot shafts 43*f* which are provided to the side frames 1. The arm pivot shaft 43*f*, which couples the footrest arm 41*f* to the footrest attachment frame portion, extends perpendicularly to the side frame 1. The footrest arm 41*f* can pivot about the arm pivot shaft 43*f* between the arm unfolded and folded positions. The pivot direction of the footrest arm 41*f* is parallel to the vertical plane of the side frame 1, as shown in FIG. 18, the fore ends of footrest arms 41*f* are positioned in front of the side frames 1, and on the exterior side relative to the exterior surfaces of the side frames 1 in the arm unfolded position of the footrest arm 41*f*. The footrest plates 71 and 72 are coupled to the fore ends of the footrest arms 41*f*.

(Footrest Plate Set 70)

Figure 19:
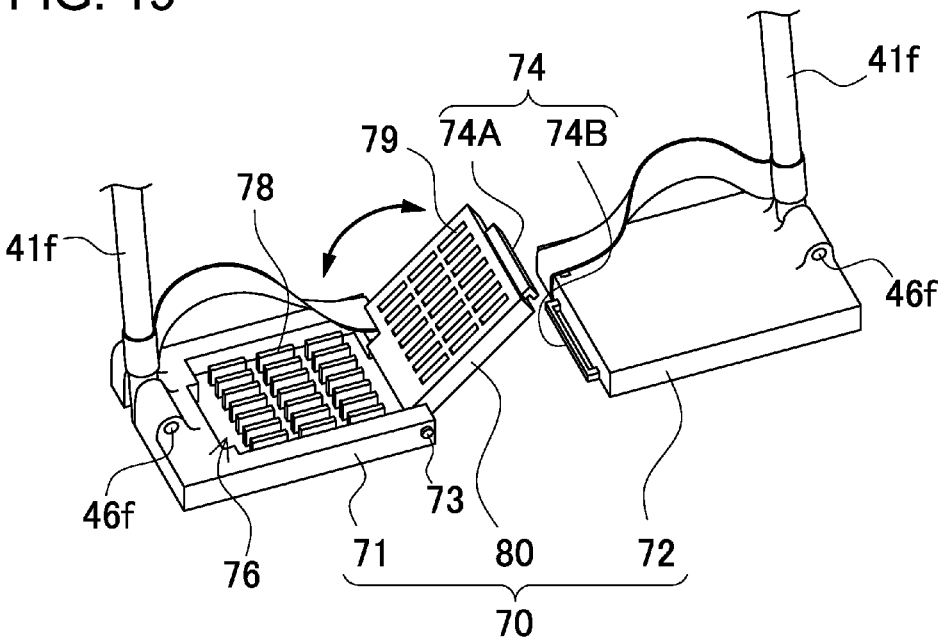
FIG. 19 is an enlarged view showing the essential part of the wheelchair shown in FIG. 18.

FIG. 19 is an enlarged view showing the essential part of the footrest equipment 8*f* of the wheelchair shown in FIG. 18. In order to pivot between plate unfolded and folded positions, the footrest arms 71 and 72 are coupled to the fore ends of the footrest arms 41*f* through of the plate pivot shafts 46*f*. The central plate 80 is coupled to the first footrest plate 71, which is one of the right and left footrest plates of the footrest plate set 70. The central plate 80 can be connected to the second footrest plate 72, which is another footrest plate. This footrest plate set 70 can be used as a single continuous footrest plate constructed of the central plate 80, and the first and second footrest plates 71 and 72 by connecting the central plate 80 to the second footrest plate 72. Since the central plate 80 can bridge the gap between the first and second footrest plates 71 and 72, the possibility can be effectively reduced that user's foot slip off the first or second footrest plate 71 and 72 through the space between the footrest plates 71 and 72.

(Central Plate 80)

The base end of the central plate 80 shown in FIG. 19 is hinged to the interior end of the first footrest plate 71 by a central plate pivot shaft 73. Accordingly, the central plate 80 can pivot so that its free end can move along an arc between the first footrest plate 71 side and the second footrest plate 72 side. Engagement portions 74 are provided in the free end part of the central plate 80 and the interior end of the second footrest plate 72. The engagement portions 74 can engage with each other. The engagement portions 74 shown in FIG. 19 are a hook part 74A, and a slot-forming part 74B into which hook part 74A is inserted. As shown in FIG. 19, the hook part 74A is formed in the free end part of the central plate 80. The hook part 74A can engage with the slot-forming part 74B, which is arranged in the interior end of the second footrest plate 72. When the footrest equipment 8*f* is used, the engagement portions 74 can engage with each other so that the first and second footrest plates 71 and 72 are coupled to each other through the central plate 80. As a result, the first and second footrest plates 71 and 72, and the central plate 80 can be used as a single continuous footrest plate.

(First Footrest Plate 71)

Figure 20:
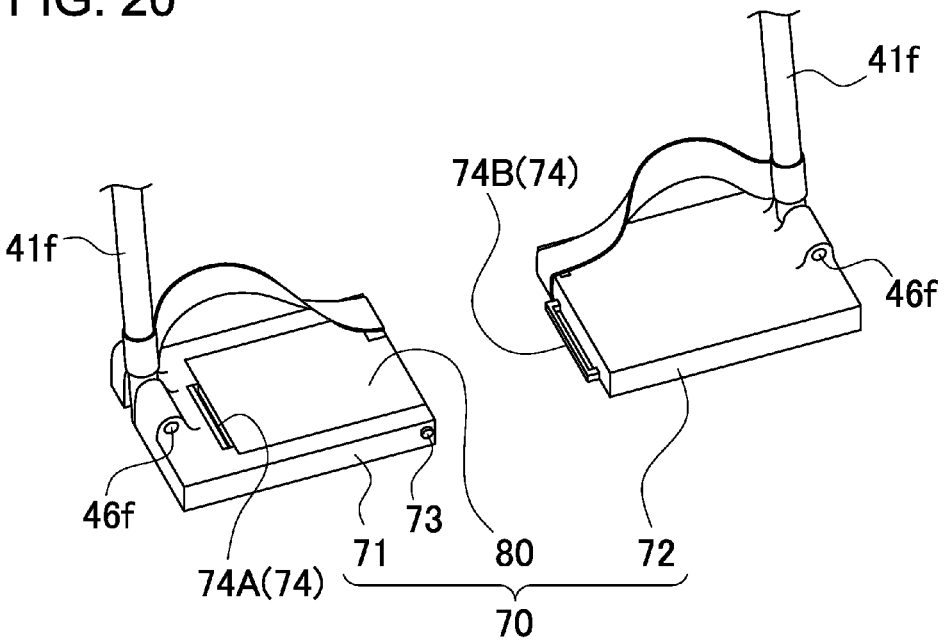
FIG. 20 is a perspective view the essential part of the wheelchair shown in FIG. 19 with a central plate being accommodated.

A recessed part 76 is formed on the upper surface of the first footrest plate 71. The shape of the recessed part 76 corresponds to the central plate 80. In the case where the first and second footrest plates 71 and 72 are not connected to each other by the central plate 80, the central plate 80 can fit in the recessed part 76. Thus, the central plate 80 can be accommodated in the first footrest plate 71. FIG. 20 is a perspective view showing that the central plate 80 is accommodated in the first footrest plate 71. As shown in FIG. 20, since the central plate 80 can be accommodated in the first footrest plate 71, the central plate 80 can avoid contact with something in front of the user or does not come in contact with something beside the way of the footrest arm in the pivot movement when the central plate 80 is not used or when the footrest arms 41*f* pivot rearward. It is preferable that the back surface of the central plate 80 and the upper surface of the first footrest plate 71 form a substantially flat surface when the central plate 80 is accommodated. In this case, the user of the wheelchair according to this embodiment can use the first footrest plate 71 similarly to the footrest plate 71 in the foregoing embodiments when the central plate is accommodated. Alternatively, non-slip protrusions (not shown), or the like may be formed on the back surface of the central plate, and the upper surface of the first footrest plate.

(Protrusions 78 and Hollows 79)

A plurality of protrusions 78 are formed in the recessed part 76 of the first footrest plate 71 of the footrest plate set 70 shown in FIG. 19. Also, hollows 79 are provided in the main surface of the central plate 80. The protrusions 78 can be inserted into the hollows 79. These protrusions 78 can support the use's foot to prevent user's foot from getting into the recessed part 76 even when the central plate 80 pivots from the first footrest plate 71 and is connected to the second footrest plate 72 in the case where the user put user's foot on the first footrest plate 71. Since the hollows 79 corresponding to the protrusions 78 are provided in the main surface of the central plate 80, when the central plate 80 is folded into the first footrest plate 71, the protrusions 78 can fit in the corresponding hollows 79. As a result, the central plate 80 can be accommodated in the first footrest plate 71 without interference with the protrusions 78 when the central plate 80 is folded as shown in FIG. 20.

(Modified Protrusions and Hollows)

A plurality of protrusions 78 and a plurality of hollows 79 are arranged in each row as shown in FIG. 19. According to this arrangement, one hollow do not continuously extend in the right-and-left direction of the central plate 80 but the hollows 79 are provided in the right-and-left direction, which means that such one continuous hollow is divided into the hollows 79, in other words, ribs are formed between the hollows 79. For this reason, the strength of the central plate 80 can be improved. However, the arrangement of the protrusions and the hollows according to this embodiment is not limited to this. The number of the protrusions or the hollows in one line or one row is not limited. One protrusion or hollow may be provided in one line or one row. Alternatively, two or more protrusions or hollows may be provided in one line or one row. In the case where the number of protrusions or hollows is small, they can be easily formed. Contrary to this, in the case where the number of protrusions or hollows is larger, the strength of the central plate can be increased. The reason is that the ribs between the hollows can be densely provided. The shape of the protrusions and the hollows is not limited. For example, the protrusions and the hollows can be also arranged in an oblique direction relative to the first footrest plate and the central plate so that the first footrest plate and the central plate can be reinforced. The hollows may be through holes. In the case where the hollows are through holes, the structure of the central plate can be easily formed. In the case, it is preferable that the top surfaces of the protrusions are substantially coplanar with the main surface of the central plate when the central plate is accommodated in the first footrest plate since such an arrangement of the protrusions can provide a normal, flat footrest plate.

Figure 21:
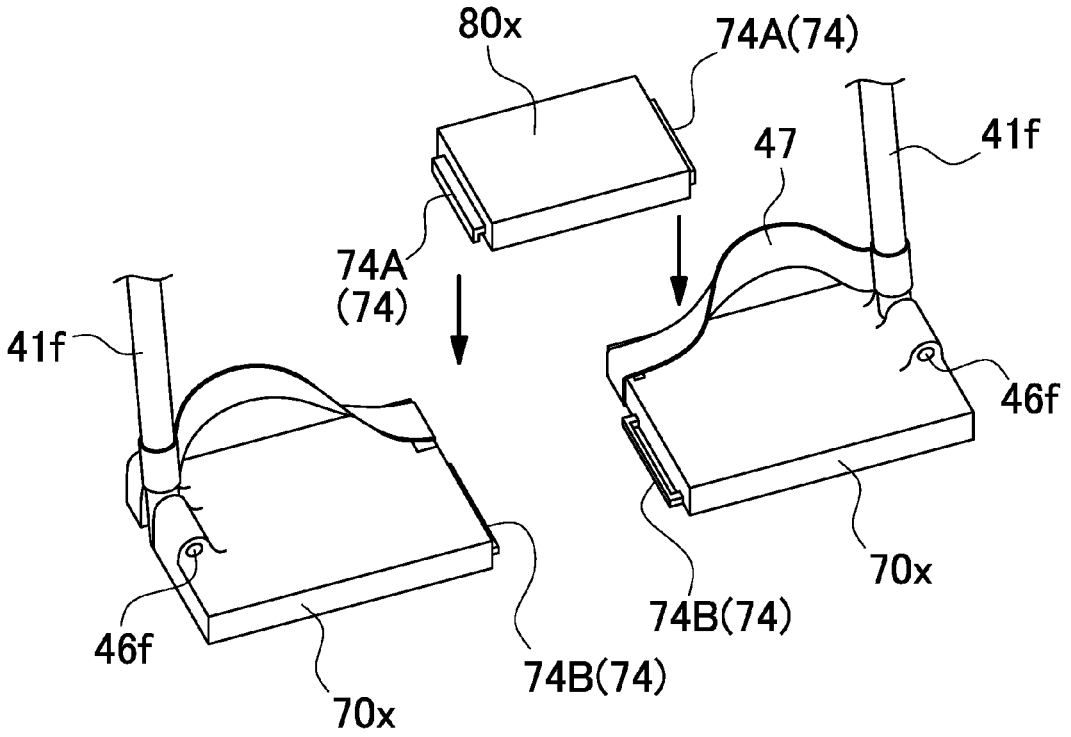
FIG. 21 is a perspective view showing a modified embodiment of the present invention.
Figure 22:
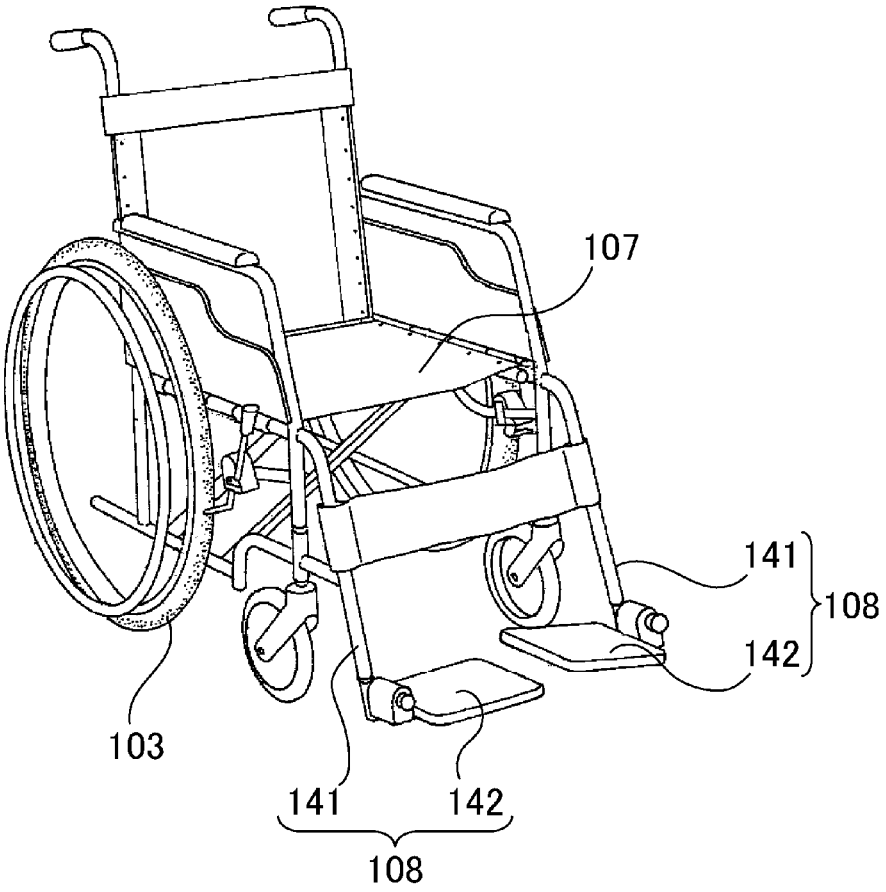
FIG. 22 RELATED ART
FIG. 22 is a perspective view showing a known wheelchair described in the related art.

However, the central plate is not necessarily hinged to the interior end of the right or left footrest plate. FIG. 21 is an enlarged view showing the essential part of a wheelchair according to a modified example of the fifth embodiment. As shown in FIG. 21, hook parts 74A are provided on the both ends of a central plate 80*x*, and slot-forming parts 74B are provided on the interior ends of footrest plates 70*x*. The hook parts 74A can be inserted into the slot-forming parts 74B. According to this construction, the central plate 80*x* can be detachably attached to the footrest plates 70*x*. Instead of the hinged central plate, a central plate may slide from one of the footrest plates, which is provided with the slidable central plate, to another footrest plate although not illustrated.

The wheelchairs of the fifth embodiment and its modified example have been described. Although the arm pivot shafts 43*f* extend perpendicularly to the side frames 1 in the wheelchair of the fifth embodiment, the arm pivot shafts do not necessarily extend perpendicularly to the side frames. The arm pivot shafts may be inclined so that the right and left footrest plates can be positioned closer to each other similar to the first and second embodiments, and in addition to this the central plate can bridge the gap between the right and left footrest plates.

According to the wheelchair of the present invention, the footrest arms can pivot in the fore-and-aft direction, and the opposed edges of the right and left footrest plates can be closer in the arm unfolded position of the footrest arms. Therefore, the possibility can be reduced that user's foot slip off right or left footrest plate through the space between the footrest plates.

Obviously, numerous modifications and variations of the present invention are possible in light of the above teachings. It is therefore to be understood that within the scope of the appended claims, the invention may be practiced otherwise than as specifically described herein.

What is claimed is:

1. A wheelchair comprising:

a pair of side frames;

driving wheels rotatably supported on said side frames, said driving wheels being coupled to exterior sides of said side frames;

footrest arms movable between arm unfolded and folded positions, each of said footrest arms being pivotably coupled to an arm pivot shaft that is positioned on the exterior side of each of said side frames on a front side relative to each of said driving wheels; and footrest plates that can support a user's feet, each of said footrest plates being pivotably coupled to a fore end of each of said footrest arms by a plate pivot shaft, wherein the distance between the fore ends of said footrest arms in the arm unfolded position is smaller than the distance between the fore ends of said footrest arms in the arm folded position, wherein said arm pivot shaft is inclined so that one of the ends of said arm pivot shaft, which is located on an exterior side of the wheelchair, is positioned lower than the other end, which is located on an interior side of the wheelchair, as viewed in front view.

2. The wheelchair according to claim 1, wherein in the arm unfolded position, the fore ends of said footrest arms are positioned on the interior side of the wheelchair relative to a base end of said footrest arm.

3. The wheelchair according to claim 1, wherein said arm pivot shaft is inclined in the vertical or horizontal plane, or both in the vertical and horizontal planes.

4. The wheelchair according to claim 1, wherein each of said footrest arms is coupled to said arm pivot shaft and inclined relative to said arm pivot shaft at such an angle that the fore end of said footrest arm is positioned on the interior side relative to a perpendicular plane that passes through the intersection between said footrest arm and said arm pivot shaft and is perpendicular to said arm pivot shaft.

5. The wheelchair according to claim 4, wherein each of said footrest arms stands upright in the arm folded position as viewed in front view.

6. The wheelchair according to claim 1, wherein the inclination angle of said arm pivot shaft relative to the horizontal or fore-and-aft direction of the wheelchair falls within the range from 1° to 30°.

7. The wheelchair according to claim 1, wherein each of said footrest arms includes a plate-pivoting shaft that pivotably supports said footrest plate coupled to said footrest arm, and wherein said plate-pivoting shaft is inclined from the extension direction of said footrest arm toward the fore-and-aft direction of the wheelchair as viewed in plan view.

8. The wheelchair according to claim 7, wherein each of said footrest plates has a roughly rectangular shape as viewed in plan view, wherein the inclination angle of said plate-pivoting shaft relative to the extension direction of said footrest arms is designed so that said plate-pivoting shaft extends parallel to the fore-and-aft direction of the wheelchair.

9. The wheelchair according to claim 1, wherein each of said footrest arms comprises:

a first arm portion that has a base end coupled to said side frame, and a middle portion bent downward;

a second arm portion that has a rear end coupled to a fore end of said first arm portion, and a fore end coupled to said footrest plate; and a rotation portion that rotatably couples said second arm portion to said first arm portion about said first arm portion as the rotation axis.

10. The wheelchair according to claim 1, wherein each of said footrest arms comprises:

a first arm portion that has a base end coupled to said side frame;

a second arm portion that has a rear end coupled to a fore end of said first arm portion, a middle portion bent downward, and a fore end coupled to said footrest plate; and a rotation portion that rotatably couples said second arm portion to said first arm portion about said first arm portion as the rotation axis.

11. The wheelchair according to claim 1, wherein opposed parts of said footrest plates at least partially contact each other in a plate unfolded position of said footrest plates.

12. The wheelchair according to claim 1, wherein first and second engagement portions that can engage with each other are provided on opposed parts of said footrest plates.

13. A wheelchair comprising:

a pair of side frames;

driving wheels rotatably supported on said side frames, said driving wheels being coupled to exterior sides of said side frames;

footrest arms movable between arm unfolded and folded positions, each of said footrest arms being pivotably coupled to an arm pivot shaft that is positioned on the exterior side of each of said side frames on a front side relative to each of said driving wheels; and footrest plates that can support user's feet, each of said footrest plates being pivotably coupled to a fore end of each of said footrest arms by a plate pivot shaft, wherein the distance between the fore ends of said footrest arms in the arm unfolded position is smaller than the distance between the fore ends of said footrest arms in the arm folded position, wherein said arm pivot shaft is inclined relative to each of said side frames so that one of the ends of said arm pivot shaft, which is located on an exterior side of the wheelchair, is positioned on the front side relative to the other end, which is located on an interior side of the wheelchair, as viewed in plan view.

14. A wheelchair comprising:

a pair of side frames;

driving wheels rotatably supported on said side frames, said driving wheels being coupled to exterior sides of said side frames;

footrest arms movable between arm unfolded and folded positions, each of said footrest arms being pivotably coupled to an arm pivot shaft that is positioned on an exterior side of each of said side frames on a front side relative to each of said driving wheels;

right and left footrest plates that can support a user's feet, each of said footrest plates being pivotably coupled to a fore end of each of the footrest arms by a plate pivot shaft; and a central plate that has sides coupled to opposed sides of said right and left footrest plates, and a main surface that serves, together with said right and left footrest plates, to be able to support the user's feet, wherein one of the sides of said central plate is hinged to an interior side of one of said right and left footrest plates, and another side of said central plate is provided with an engagement portion that can engage with the opposed side of the other of said right and left footrest plates, which is located opposite to the hinged side, and wherein a recessed part is formed on an upper surface of the one of said right and left footrest plates to which said central plate is hinged, and the central plate can fit in the recessed part so that said central plate can be accommodated in the one of said right and left footrest plates.

15. The wheelchair according to claim 14, wherein protrusions are provided in the recessed part of the one of said right and left footrest plates, and hollows are provided on a main surface of said central plate, wherein the protrusions can fit in the hollows.

* * * * *